US010031448B2

(12) United States Patent
Yoshimura

(10) Patent No.: US 10,031,448 B2
(45) **Date of Patent: *Jul. 24, 2018**

(54) IMAGE HEATING APPARATUS AND IMAGE FORMING APPARATUS HAVING A CONTROLLER THAT CONTROLS TEMPERATURE OF A ROTATABLE MEMBER BASED ON EXECUTION OF A RUBBING PROCESS

(71) Applicant: CANON KABUSHIKI KAISHA, Tokyo (JP)

(72) Inventor: Tomohiko Yoshimura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/049,496

(22) Filed: Feb. 22, 2016

(65) Prior Publication Data

US 2016/0170344 A1 Jun. 16, 2016

Related U.S. Application Data

(63) Continuation of application No. PCT/JP2014/073842, filed on Sep. 3, 2014.

(30) Foreign Application Priority Data

Sep. 3, 2013 (JP) ..... 2013-182050

(51) Int. Cl.
*G03G 15/20* (2006.01)

(52) U.S. Cl.
CPC ..... *G03G 15/2039* (2013.01); *G03G 15/205* (2013.01); *G03G 15/2025* (2013.01)

(58) Field of Classification Search
None
See application file for complete search history.

(56) References Cited

U.S. PATENT DOCUMENTS 7,224,922 B2 5/2007 Kemmochi
7,251,432 B2 7/2007 Yoneda et al.
(Continued)

FOREIGN PATENT DOCUMENTS

CN 1740923 A 3/2006
CN 101995799 A 3/2011
(Continued)

OTHER PUBLICATIONS

U.S. Appl. No. 15/048,403, filed Feb. 19, 2016.
(Continued)

*Primary Examiner* — Victor Verbitsky
(74) *Attorney, Agent, or Firm* — Fitzpatrick, Cella, Harper & Scinto

(57) ABSTRACT

An image heating apparatus includes a first rotatable member and a second rotatable member configured to form a nip for heating a toner image on a sheet, a rotatable rubbing member configured to rub an outer surface of the first rotatable member, a motor configured to move the rotatable rubbing member from a position in which the rotatable rubbing member is spaced from the first rotatable member toward a position in which the rotatable rubbing member contacts the first rotatable member, when a rubbing process is executed by the rotatable rubbing member, and a controller configured to control a temperature of the first rotatable member, depending on a number of times the rubbing process is executed by the rotatable rubbing member, when the rubbing process is executed.

50 Claims, 21 Drawing Sheets

(56) References Cited

U.S. PATENT DOCUMENTS

| | | | | |
|---|---|---|---|---|
| 7,430,392 | B2 | 9/2008 | Ito et al. | |
| 7,460,821 | B2 * | 12/2008 | Ai | G03G 15/2025 399/328 |
| 7,756,458 | B2 | 7/2010 | Viney et al. | |
| 8,280,289 | B2 | 10/2012 | Yamanaka et al. | |
| 8,306,446 | B2 * | 11/2012 | Ito | G03G 15/2039 399/329 |
| 8,422,928 | B2 | 4/2013 | Maruko et al. | |
| 8,917,999 | B2 | 12/2014 | Takada et al. | |
| 8,971,735 | B2 | 3/2015 | Yoshimura | |
| 2005/0185978 | A1 * | 8/2005 | Kemmochi | G03G 15/2017 399/69 |
| 2008/0038026 | A1 | 2/2008 | Ai et al. | |
| 2008/0038027 | A1 | 2/2008 | Ito et al. | |
| 2008/0138126 | A1 | 6/2008 | Viney et al. | |
| 2011/0129266 | A1 | 6/2011 | Maruko et al. | |
| 2011/0176823 | A1 * | 7/2011 | Kameda | G03G 15/5029 399/45 |
| 2013/0058672 | A1 | 3/2013 | Takada et al. | |
| 2014/0318931 | A1 | 10/2014 | Takematsu et al. | |

FOREIGN PATENT DOCUMENTS

| | | | |
|---|---|---|---|
| CN | 102968035 | A | 3/2013 |
| JP | 2005-266785 | A | 9/2005 |
| JP | 2008-40363 | A | 2/2008 |
| JP | 2008-040364 | A | 2/2008 |
| JP | 2008-146070 | A | 6/2008 |
| JP | 2011-118087 | A | 6/2011 |
| JP | 2013-15631 | A | 1/2013 |
| JP | 2013-54108 | A | 3/2013 |

OTHER PUBLICATIONS

U.S. Appl. No. 14/844,387, filed Sep. 3, 2015.

International Search Report issued on Oct. 28, 2014 in PCT/JP2014/073842.

Office Action dated Nov. 30, 2017, issued in counterpart Chinese Patent Application No. 201480056285.9.

* cited by examiner

IMAGE HEATING APPARATUS AND IMAGE FORMING APPARATUS HAVING A CONTROLLER THAT CONTROLS TEMPERATURE OF A ROTATABLE MEMBER BASED ON EXECUTION OF A RUBBING PROCESS

TECHNICAL FIELD

The present invention relates to an image heating apparatus for heating a toner image on a sheet and an image forming apparatus including the image heating apparatus. As this image forming apparatus, it is possible to cite an image forming apparatus such as a copying machine, a printer, FAX and a multi-function machine or the like having a plurality of functions of these machines.

BACKGROUND ART

Conventionally, in the image forming apparatus using an electrophotographic type, a fixing device for fixing the toner image, formed on a recording material (sheet), at a nip between two fixing members (first and second rotatable fixing members) is mounted.

In such a fixing device, with repetition of a fixing process, the fixing member is abraded by an edge portion (both end portions with respect to a direction perpendicular to a recording material feeding direction) of the recording material, so that a surface property thereof has a tendency that the surface property is deteriorated compared with the surface property in another region. Specifically, there is a tendency that a surface of the fixing member in a region contacting the edge portion of the recording material is roughened. When the surface property of such a fixing member becomes non-uniform, the surface property appears on a fixed image, so that there is a liability that glossiness of an image is not uniform.

Therefore, in a fixing device described in Japanese Laid-Open Patent Application 2008-040363, a roughening roller (rotatable rubbing member) for rubbing the surface of the fixing member is provided. Specifically, the fixing member is rubbed with the roughening roller, whereby a deteriorated state (surface roughness) of a portion thereof contacting the edge portion of the recording material is made inconspicuous compared with another portion.

According to study by the present inventor, it was found that during repetition of a rubbing process, the roughening roller is clogged with shaving (cuttings) and rubbing power lowers due to the clogging with the shavings. When such a situation generates, it becomes difficult to efficiently restore the surface property of the fixing member, so that there is room for improvement.

SUMMARY OF THE INVENTION

An object of the present invention is to properly perform a rubbing process in the case where rubbing power of a rotatable rubbing member lowered.

According to an aspect of the present invention, there is provided an image heating apparatus comprising: first and second rotatable members configured to form a nip for heating a toner image on a sheet; a rotatable rubbing member configured to rub an outer surface of the first rotatable member; and a contact-and-separation mechanism configured to move the rotatable rubbing member toward and away from the first rotatable member; and a controller configured to control a temperature of the first rotatable member, depending on a number of times of a rubbing process executed by the rotatable rubbing member, when the rubbing process is executed.

According to another aspect of the present invention, there is provided an image heating apparatus comprising: first and second rotatable members configured to form a nip for heating a toner image on a sheet; a rotatable rubbing member configured to rub an outer surface of the first rotatable member; and a contact-and-separation mechanism configured to move the rotatable rubbing member toward and away from the first rotatable member; and a controller configured to control a temperature of the first rotatable member, depending on a total time of contact of the rotatable rubbing member with the first rotatable member, when the rubbing process is executed.

Effect of the Invention

According to the present invention, in the image heating apparatus and the image forming apparatus in which the rotatable rubbing member is included, it is possible to properly perform the rubbing process even in the case where the rubbing power of the rotatable rubbing member lowered.

EMBODIMENTS FOR CARRYING OUT THE INVENTION

Preferred embodiments for carrying out the present invention will be exemplarily described in detail using the drawings below.

(Image Forming Apparatus)

Figure 2:
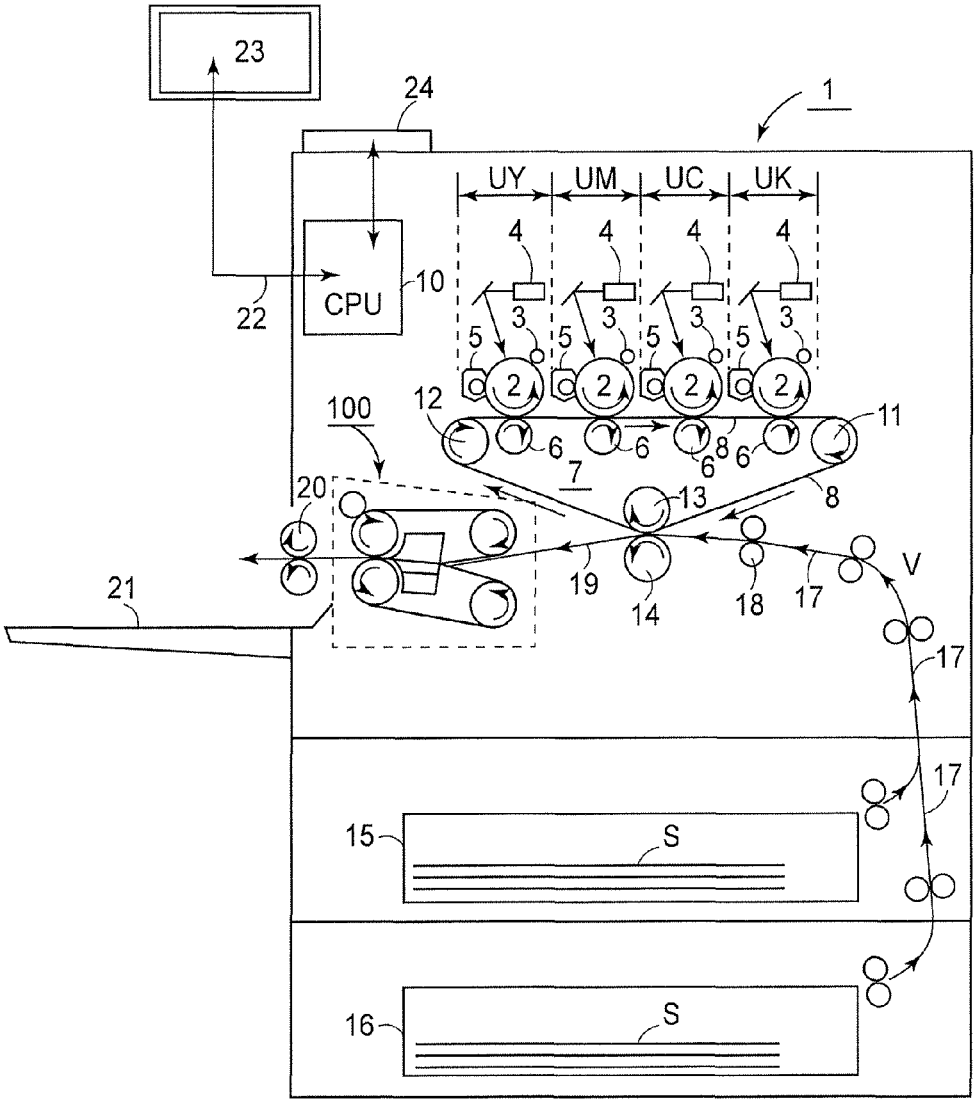
FIG. 2 is a sectional view for illustrating an image forming apparatus in which the fixing device is mounted.

FIG. 2 is a schematic structural view of an image forming apparatus 1 in this embodiment and is taken along a feeding direction V of a sheet (recording material) S. This image forming apparatus 1 is a full-color electrophotographic printer (hereinafter referred to as a printer) using an intermediary transfer member. This printer 1 is capable of forming an image corresponding to image data (electrical image information) inputted from an external host device 23 connected with a printer controller (hereinafter referred to as CPU) 10 which is a controller via an interface 22 and capable of outputting an image-formed product.

The CPU 10 is a control means for effecting integrated control of an operation of the printer 1, and transfers various electrical information signals between itself and the external host device 23 or a printer operating portion 24. Further, the CPU 10 effects processing of the electrical information signals inputted from various process devices and sensors and the like, processing of instruction (command) signals sent to the various process devices, predetermined initial sequence control and predetermined image forming sequence control. The external host device 23 may be, e.g., a personal computer, a network, an image reader, a facsimile machine, and the like.

Inside the printer 1, an image forming portion for forming toner images on the sheet (recording material) S is provided. Specifically, as the image forming portion, first to fourth (four) image forming stations U (UY, UM, UC, UK) are juxtaposed from a left side to a right side. The respective image forming stations U are the same electrophotographic image forming mechanism which are the same in constitution except that the colors of toners as developers accommodated in developing devices 5 are yellow (Y), magenta (M), cyan (C) and black (K) which are different from each other.

That is, each of the image forming stations U includes an electrophotographic photosensitive member 2 (hereinafter referred to as a drum) and includes, as a process device acting on the drum 2, a charging roller 3, a laser scanner 4, a developing device 5, a primary transfer roller 6, and the like.

The drum 2 of each image forming station U is rotationally driven in the counterclockwise direction indicated by an arrow at a predetermined speed. Then, on the drum 2 of the first image forming station UY, a toner image of Y corresponding to a Y component image for a full-color image to be formed is formed. On the drum 2 of the second image forming station UM, a toner image of M corresponding to an M component image is formed. Further, on the drum 2 of the third image forming station UC, a toner image of C corresponding to a C component image is formed. On the drum 2 of the fourth image forming station UK, a toner image of K corresponding to a K component image is formed. Toner image forming processes and principles on the drums 2 of the respective image forming stations U are well known well-known and therefore will be omitted from description.

On a lower side of the respective image forming stations U, an intermediary transfer belt unit 7 is provided. This unit 7 includes a flexible endless intermediary transfer belt 8 as an intermediary transfer member. The belt 8 is extended and stretched among three rollers consisting of a driving roller 11, a tension roller 12, and a secondary transfer opposite roller 13. The belt 8 is circulated and moved in the clockwise direction indicated by an arrow at a speed corresponding to the rotational speed of the drums 2 by driving the driving roller 11. The secondary transfer opposite roller 13 is contacted to the belt 8 toward a secondary transfer roller 14 at a predetermined pressure (urging force). A contact portion between the belt 8 and the secondary transfer roller 14 is a secondary transfer nip.

The primary transfer rollers 6 of the image forming stations U are provided inside the belt 8 and are contacted to the belt 8 toward lower surfaces of the drums 2. At each image forming station U, a contact portion between the drum 2 and the belt 8 is a primary transfer nip. To the primary transfer roller 6, a predetermined primary transfer bias is applied at a predetermined control timing.

The toner images of Y, M, C and K formed on the drums 2 of the image forming station U are successively primary-transferred superposedly at the primary transfer portions onto the surface of the belt 8 which is circulated and moved. As a result, an unfixed full-color toner image including the superposed four color toner images is synthetically formed on the belt 8 and is conveyed to the secondary transfer nip.

On the other hand, sheets S accommodated in a first sheet feeding cassette 15 or a second sheet feeding cassette 16 are separated one by one by an operation of a sheet feeding mechanism, and then the separated sheet S is passed through a feeding path 17 to be sent to a registration roller pair 18. The registration roller pair 18 simultaneously receives and stops the sheet S, and corrects, in the case where the sheet S is obliquely moved, the sheet S to a straight movement state. Then, the registration roller pair 18 feeds the sheet S to the secondary transfer nip in synchronism with the toner image on the belt 8.

In a period in which the sheet S is nipped and fed at the secondary transfer nip, to the secondary transfer roller 14, a predetermined secondary transfer bias is applied. As a result, the full-color toner image is collectively secondary-transferred from the belt 8 onto the sheet S. Then, the sheet S coming out of the secondary transfer nip is separated from the surface of the belt 8 and is passed through a feeding path 19 to be guided into a fixing device 100 as an image heating apparatus. The sheet S is heated and pressed in the fixing device 100, so that the unfixed toner image on the sheet is fixed as a fixed image. The sheet S coming out of the fixing device 100 is fed and discharged, as a full-color image-formed product, onto a discharge tray 21 by a discharging roller pair 20.

(Fixing Device 100)

Figure 3:
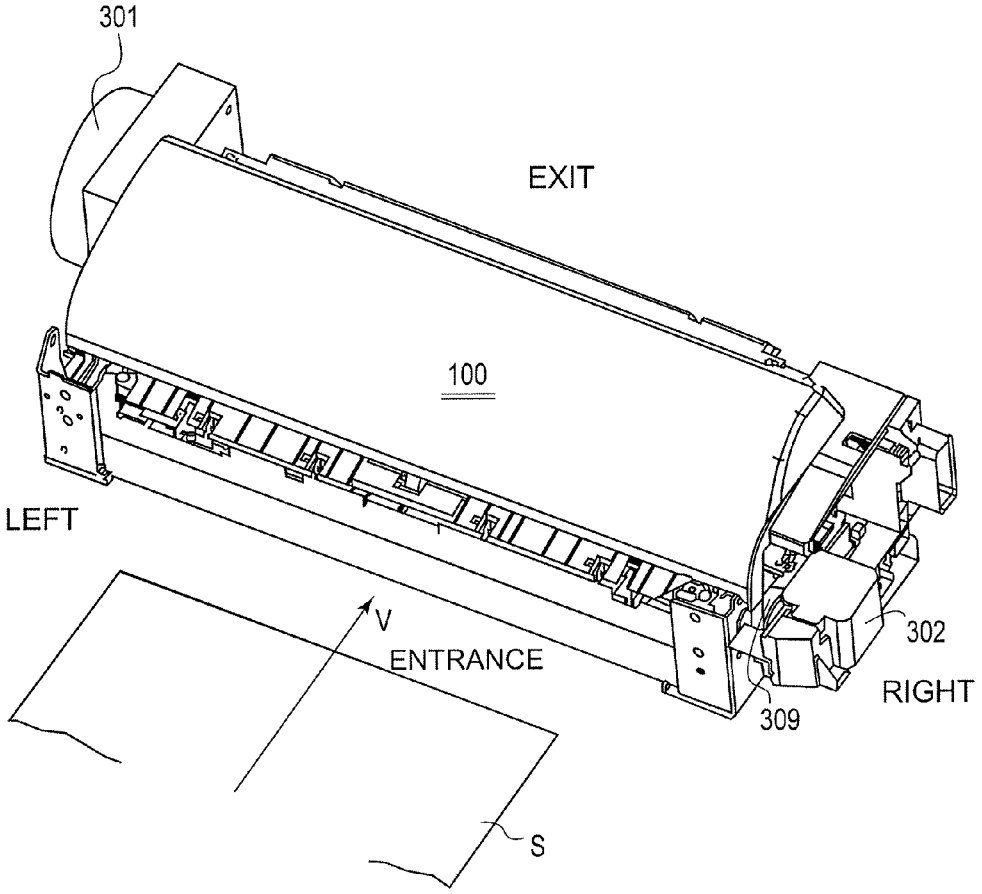
FIG. 3 is a perspective view of an outer appearance of the fixing device.
Figure 4:
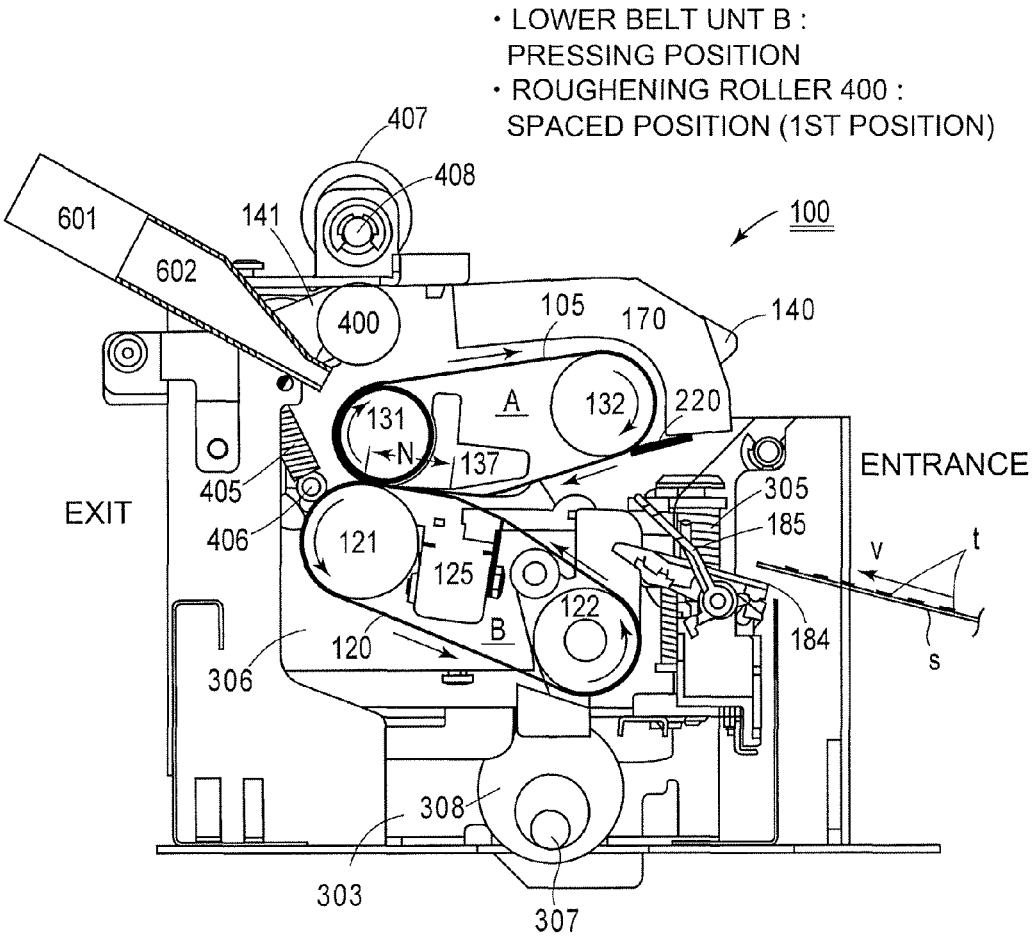
FIG. 4 is a left side view (during the pressing state of the lower-side belt assembly B) of the principal part of the fixing device.
Figure 5:
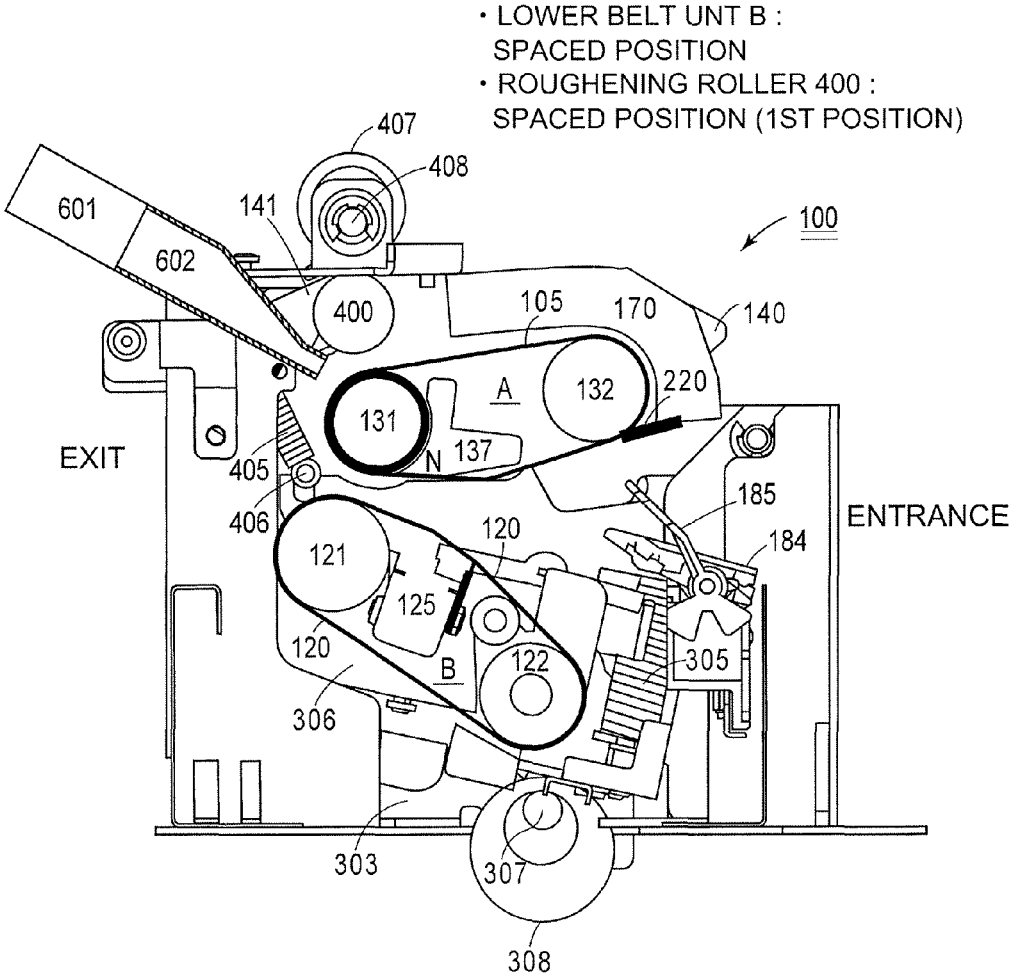
FIG. 5 is a left side view (during a spaced state of the lower-side belt assembly B) of the principal part of the fixing device.

FIG. 3 is a perspective view of an outer appearance of the fixing device 100 in this embodiment. FIG. 4 is a cross-sectional left side view of a principal portion of the image forming apparatus 100 and shows an urged state of a lower-side belt assembly B. FIG. 5 is a cross-sectional right side view of a principal part of the device 100 and shows a pressure-eliminated state of the lower-side belt assembly B.

Figure 6:
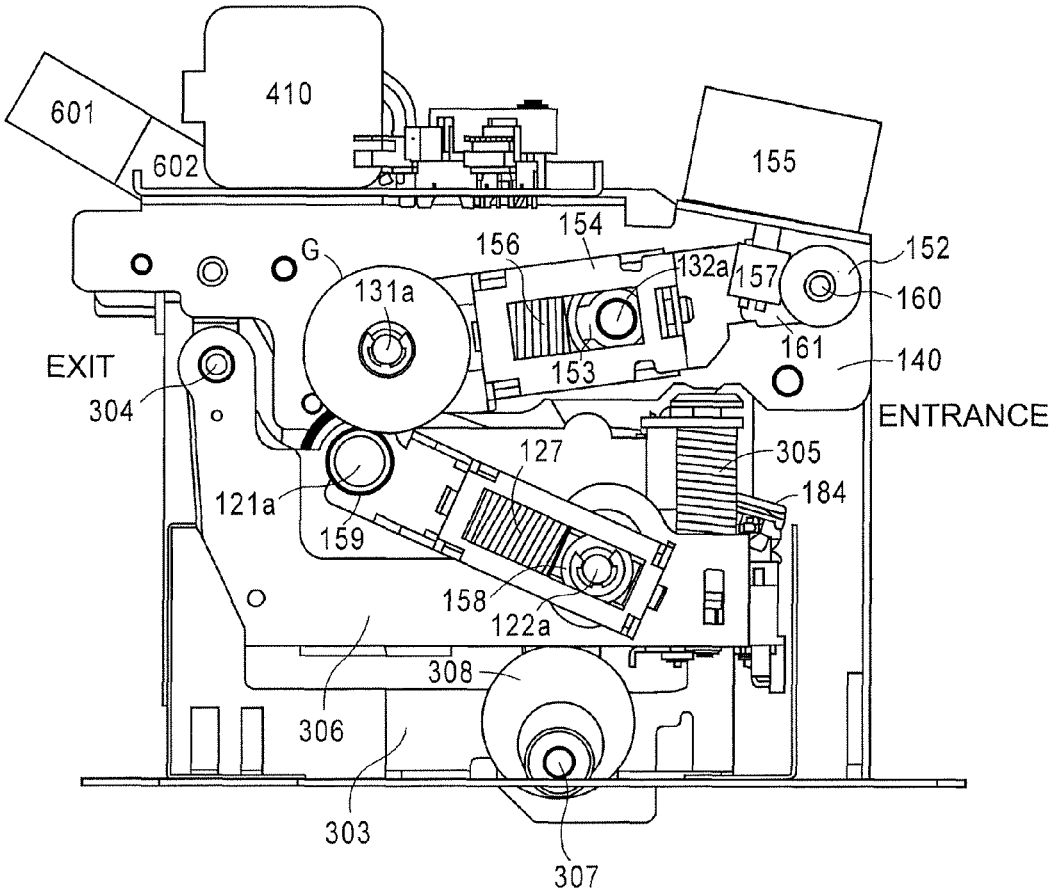
FIG. 6 is a left side view (during the pressing state of the lower-side belt assembly B) of the principal part of the fixing device.
Figure 7:
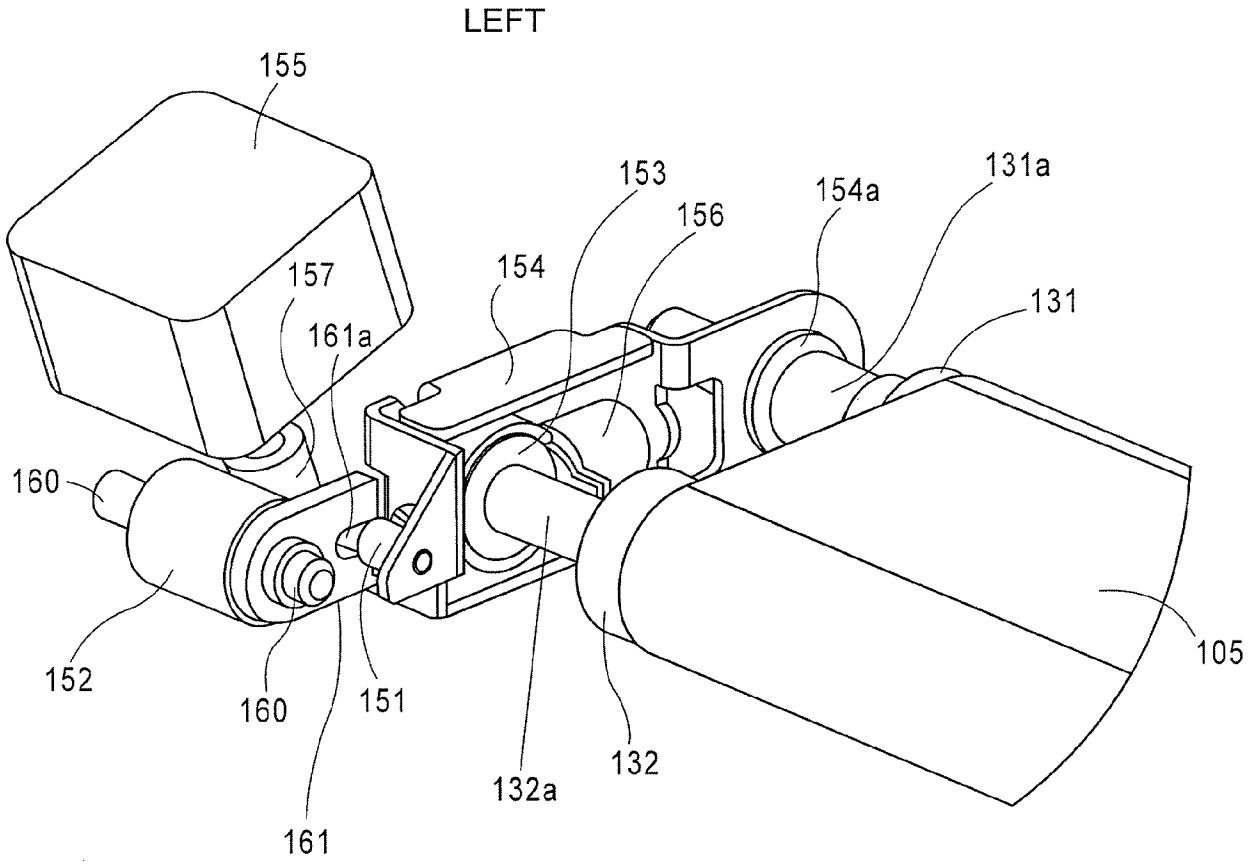
FIG. 7 is a perspective view of a belt shift control mechanism portion of the fixing device.

FIG. 6 is a left side view of the principal part of the device 100 and shows a pressed state of the lower-side belt assembly B. FIG. 7 is a perspective view of a belt shift control mechanism portion.

Here, with respect to the fixing device 100 or members constituting the fixing device 100, a longitudinal direction (longitudinal) or a widthwise direction (width) is a direction (or a dimension in the direction) parallel to a direction perpendicular to a feeding direction V of the sheet S shown in FIG. 2 in a sheet feeding path plane of the fixing device. A short direction (short) is a direction (or a dimension in the direction) parallel to the sheet feeding direction V in the sheet feeding path plane of the fixing device.

Further, with respect to the fixing device 100, a front surface (side) is a surface on a sheet entrance side, and a rear surface (side) is a surface on a sheet exit side, and left or right are left or right when the device is viewed from the front surface. In this embodiment, the right side is a front side, and the left side is a rear side. Upper side (up) and lower side (down) are those with respect to the direction of gravitation. Upstream side and downstream side are those with respect to the sheet feeding direction V. A width of the belt or the sheet is a dimension with respect to a direction perpendicular to the sheet feeding direction. Here, the fixing device 100 in this embodiment is an image heating apparatus of a twin belt nip type, an electromagnetic induction heating (IH) type and an oil-less fixing type.

The fixing device 100 includes an upper-side belt assembly A as a heating unit and the lower-side belt assembly B as a pressing unit in which each of belts is driven by a motor 301 (FIG. 2). Further, the fixing device 100 includes a pressing-spacing mechanism (contact-and-separation mechanism) for the lower-side belt assembly B driven by a motor 302 (FIG. 2) relative to the upper-side belt assembly A. Further, the fixing device 100 includes an IH heater (magnetic flux generating means) 170 which is a heating portion for heating the fixing belt 105 in the upper-side belt assembly A, a shift control mechanism for the fixing belt 105, and a roughening mechanism (surface property refreshing mechanism) for restoring the surface property of the fixing belt 105. In the following, these members will be sequentially described.

1) Upper-Side Belt Assembly a and IH Heater 170

In FIG. 4, the upper-side belt assembly A is provided between left and right upper-side plates 140 (specifically in FIG. 1A) of a device casing. This assembly A includes one of two rotatable members for fixing (first rotatable member and second rotatable member) which form a nip N described later therebetween. Specifically, the assembly A includes a parting layer at its surface and includes a flexible fixing belt (endless belt) 105 as a rotatable fixing member (fixing member). Further, the assembly A includes, as a plurality of belt stretching members for stretching the fixing belt 105, a driving roller (supporting roller) 131, a steering roller 132 also functioning as a tension roller, and a pad stay 137.

The driving roller 131 is provided between the left and right upper-side plates 140 on the sheet exit side, and as shown in FIG. 7, left and right shaft portions 131*a* are rotatably supported between the left and right upper-side plates 140 via bearings (not shown). Further, at each of the outsides of the left and right upper-side plates 140, a steering roller supporting arm 154 is provided and extends from the driving roller 131 side to the sheet entrance side.

The right-side supporting arm 154 (not shown) is fixed to the upper-side plate 140 (not shown). Referring to FIG. 7, the left-side supporting arm 154 is supported by the left-side shaft 131*a* of the driving roller 131 via a bearing 154*a* and is swingable about the shaft 131*a* in an up-down direction. At a free end portion of the left-side supporting arm 154, a pin 151 is provided. At an outer surface of the upper-side plate 140, a shaft 160 is provided on the sheet entrance side.

By this shaft 160, a worm wheel (helical gear) 152 provided integrally with a fork plate 161 having a U-shaped groove portion 161*a* is rotatably supported. The pin 151 of the left-side supporting arm 154 engages with the groove portion 161*a* of the fork plate 161. Here, the upper-side plate 140 is provided with a stepping motor 155, and a worm gear 157 fixed on a rotation shaft of this stepping motor 155 engages with the worm wheel 152.

By normally driving or reversely driving the stepping motor 155, the fork plate 161 is rotationally moved in an upward direction or a downward direction via the worm gear 157 and the worm wheel 152. In interrelation with this, the left-side arm 154 is rotationally moved about the shaft 131*a* in the upward direction or the downward direction.

Then, the steering roller 132 is provided in the sheet entrance side between the left and right upper-side plates 140, and left and right shaft portions 132*a* thereof are rotatably supported by the above-described left and right supporting arms 154, respectively, via bearings 153. The bearing 153 is supported slidably and movably in a belt tension direction relative to the supporting arm 154 and is moved and urged in a spacing direction from the driving roller 131 by a tension spring 156.

In FIG. 4, the pad stay 137 is a member formed of, e.g., stainless steel (SUS material). This pad stay 137 is fixed and supported between the left and right upper-side plates 140 at its left and right end portions so that the pad stay 137 is located inside the fixing belt 105 and closely to the driving roller 131 between the driving roller 131 and the steering roller 132 with a pad receiving surface facing downward.

The fixing belt 105 which is extended around the driving roller 131, the steering roller 132, and the pad stay 137, is under application of a predetermined tension (tensile force) by movement of the steering roller 132 in the belt tension direction by an urging force of the tension spring 156. In this embodiment, a tension of 200 N is applied. Further, a lower-side belt portion of the fixing belt 105 is contacted at its inner surface to the downward pad receiving surface of the pad stay 137.

As the fixing belt 105, any belt may be appropriately selected so long as the belt can be heated by the IH heater 170 and has heat resistance. For example, a belt prepared by coating a 300 μm-thick silicone rubber on a magnetic metal layer, such as a nickel layer or a stainless steel layer, of 75 μm in thickness, 380 mm in width and 200 mm in circumference and then by coating a PFA tube as a surface layer (parting layer) on the silicone rubber is used as the fixing belt 105.

The driving roller 131 is, e.g., a roller formed by integrally molding a heat-resistant silicone rubber elastic layer on a surface layer of a solid core metal formed of stainless steel in outer diameter of 18 mm. The driving roller 131 is provided in the sheet exit side in a nip region of the fixing nip N formed between the fixing belt 105 and a pressing belt 120 as a second rotatable member described later, and its elastic layer is elastically distorted in a predetermined amount by press-contact of the pressing roller 121 described later.

Here, in this embodiment, the driving roller 131 and the pressing roller 121 form a nip shape by sandwiching the fixing belt 105 and the pressing belt 121 therebetween, in a substantially straight shape. However, in order to control buckling of the sheet S due to a speed difference of the sheet S in the fixing nip N, it is also possible to form various crown shapes of the rollers in such a manner that the crown shapes of the driving roller 131 and the pressing roller 121 are intentionally formed as a reverse-crown shape or the like.

The steering roller 132 is, e.g., a hollow roller formed of stainless steel so as to have an outer diameter of 20 mm and an inner diameter of about 18 mm. This steering roller 132 functions as a tension roller which stretches the fixing belt 105 to apply tension to the fixing belt 105. In addition, the steering roller 132 functions as a roller (steering roller) for adjusting meandering of the fixing belt 105 in the widthwise direction perpendicular to a movement direction of the fixing belt 105 by being controlled in slope by a shift control mechanism described later.

To the driving roller 131, a drive input gear G (FIG. 1B) is coaxially provided and fixed on a left end side of the belt shaft 131*a*. To this gear G, drive input from the driving motor 301 (FIG. 3) is made via a drive transmission means (not shown), so that the driving roller 131 is rotationally driven in the clockwise direction, indicated by an arrow in FIG. 4, at a predetermined speed.

By the rotation of the driving roller 131, the fixing belt 105 is circulated and fed in the clockwise direction indicated by the arrow at a speed corresponding to the speed of the driving roller 131. The steering roller 132 is rotated by the circulation feeding of the fixing belt 105. The inner surface of the lower-side belt portion of the fixing belt 105 slides and moves on the downward pad receiving surface of the pad stay 137, and in order to stably feed the sheet S to the fixing nip N described later, the drive (driving force) is transmitted with reliability between the fixing belt 105 and the driving roller 131.

Here, the IH heater 170 as a heating portion for heating the fixing belt 105 shown in FIG. 4 is an induction heating coil unit constituted by an exciting coil, a magnetic core and a holder for holding these members, and the like. The IH heater 170 is disposed above the upper-side belt assembly A, and is fixed and disposed between the left and right upper-side plates 140 so that it extends from a portion of the upper surface of the fixing belt 105 to a portion of the steering roller 132 and opposes the fixing belt 105 in a non-contact manner with a predetermined gap therebetween.

When energization to the IH heater 170 as a heating portion is made, the exciting coil of the IH heater 170 generates AC magnetic flux by being supplied with an AC current, and the AC magnetic flux is guided by the magnetic material core to generate eddy current in the magnetic metal layer of the fixing belt 105 as an induction heat generating member. The eddy current generates Joule heat by specific resistance of the induction heat generating member. The AC current to be supplied to the exciting coil is controlled so that a surface temperature of the fixing belt 105 is temperature-controlled at about 140° C. to about 200° C. (target temperature) on the basis of temperature information from a thermistor 220 for detecting the surface temperature of the fixing belt 105.

2) Lower-Side Belt Assembly B and Pressing-Spacing Mechanism

In FIG. 4, the lower-side belt assembly B is provided below the upper-side belt assembly A. This assembly B is assembled with a lower frame (urging frame) 306 (FIG. 6) rotatably supported in the vertical (up-down) direction about a hinge shaft 304 (FIG. 6) fixedly provided between left and right lower-side plates 303 in the sheet exit side in the fixing device 100.

In FIG. 4, this assembly B includes another one of the two rotatable members for fixing (first rotatable member and second rotatable member). Specifically, the assembly belt includes a flexible pressing belt (endless belt) 120 as a rotatable fixing member (pressing member) for forming the nip N between the pressing belt and the fixing belt 105. Further, the assembly B includes, as a plurality of belt stretching members for stretching the pressing belt 120 as a second rotatable member with tension, a pressing roller (pressing roller) 121, a tension roller 122 and a pressing pad 125.

The pressing roller 121 is rotatably supported at left and right shaft portions 121*a* thereof between the left and right side plates of the lower frame 306 via bearings 159 as shown in FIG. 6. The tension roller 122 is rotatably supported at left and right shaft portions 122*a* thereof by the left and right side plates via bearings 158. The bearing 158 is supported slidably and movably in the belt tension direction relative to the lower frame 306 and is urged by a tension spring 127 so as to move in a spacing direction from the pressing roller 121.

Returning to FIG. 4, the pressing pad 125 is a member formed with, e.g., a silicone rubber, and left and right end portions thereof are fixed and supported between the left and right side plates of the lower frame 306. The pressing roller 121 is located on the sheet exit side between the left and right side plates of the lower frame 306. On the other hand, the tension roller 122 is located on the sheet entrance side between the left and right side plates of the lower frame 306. The pressing pad 125 is non-rotationally supported and fixedly disposed so that the pad 125 is located inside the pressing belt 120 and closely to the pressing roller 121 between the pressing roller 121 and the tension roller 122 with a pad surface upward.

The pressing belt 120 extended around the pressing roller 121, the tension roller 122 and the pressing pad 125 is under application of a predetermined tension by movement of the tension roller 122 in the belt tension direction by an urging force of the tension spring 127. In this embodiment, the tension of 200 N is applied. Here, an upper-side belt portion of the fixing belt 105 is contacted at its inner surface to the upward pad surface of the pressing pad 125.

As the pressing belt 120, any belt may be appropriately selected if the belt has heat resistance. For example, a belt prepared by coating a 300 μm-thick silicone rubber on a nickel layer of 50 μm in thickness, 380 mm in width and 200 mm in circumference and then by coating a PFA tube as a surface layer (parting layer) on the silicone rubber is used as the pressing belt 120. The pressing roller 121 is, e.g., a roller formed of a solid stainless steel in outer diameter of 20 mm, and the tension roller 122 is, e.g., a hollow roller formed of stainless steel so as to have an outer diameter of 20 mm and an inner diameter of about 18 mm.

Here, the lower-side belt assembly B is rotation-controlled about the hinge shaft 304 in the up-down direction by the pressing-spacing mechanism as a contact-and-separation means. That is, the lower-side belt assembly B is raised and rotationally moved by the pressing-spacing mechanism and thus is moved to a pressing position as shown in FIG. 4, while the lower-side belt assembly B is moved to a spaced position as shown in FIG. 5 by being raised and rotationally moved.

Further, the lower-side belt assembly B is moved to the pressing position, and thus is placed in the following state. That is, the pressing roller 121 and the pressing pad 125 are press-contacted to the pressing belt 120 toward the driving roller 131 and the pad stay 137 of the upper-side belt assembly A via the fixing belt 105. As a result, between the fixing belt 105 of the upper-side belt assembly A and the pressing belt 120 of the lower-side belt assembly B, the fixing nip N having a predetermined width with respect to the feeding direction V of the sheet S is formed. Further, the lower-side belt assembly B is moved to the spaced position, so that the pressing thereof against the upper-side belt assembly A is eliminated and the lower-side belt assembly B is spaced in a non-contact state.

Here, the above-described pressing-spacing mechanism in this embodiment will be described. In FIG. 6, a lower frame 306 is provided, on a side opposite to the hinge shaft 304 side, with a pressing spring 305 for causing the lower-side belt assembly B to elastically press-contact the upper-side belt assembly A.

At a lower portion between the left and right lower-side plates 303, a pressing cam shaft 307 is rotatably shaft-supported and disposed. On left and right sides of this pressing cam shaft 307, a pair of eccentric pressing cams 308 is provided, having the same shape and the same phase, for supporting a lower surface of the lower frame 306. On a right end side of the pressing cam shaft 307, a pressing gear 309 (FIG. 3) is coaxially fixed and disposed. To this gear 309, drive input is made from the pressing motor 302 via a drive transmitting means (not shown), so that the pressing cam shaft 307 is rotationally driven.

The pressing cam shaft 307 forms a first angular position of rotation where a largely protruded portion of the eccentric pressing cam 308 is directed upward, as shown in FIGS. 4 and 6, and a second angular position of rotation where the largely protruded portion is directed downward, as shown in FIG. 5.

The pressing cam shaft 307 is rotated to the first angular position of rotation and is stopped, so that the lower frame 306 on which the lower-side belt assembly B is mounted is raised by the largely protruded portion of the eccentric pressing cam 308. Then, the lower-side belt assembly B contacts the upper-side belt assembly A while compressing the pressing spring 305 of the pressing spring unit. As a result, the lower-side belt assembly B is pressed and urged elastically against the upper-side belt assembly A at a predetermined pressure (e.g., 400 N) by compression reaction force of the pressing spring 305, and is held at the pressing position.

Here, by the press-contact of the pressing roller 121 to the pressing belt 120 toward the driving roller 131, curvature deformation of about several hundreds of microns is generated on the driving roller 131 in a side opposite from the side where the driving roller 131 opposes the pressing roller 121. This curvature deformation of the driving roller 131 constitutes a factor of depressure at a longitudinal central portion of the fixing nip N. In order to eliminate this depressure, the driving roller 131 or both of the driving roller 131 and the pressing roller 121 are formed in a crown shape, so that a nip shape provided by the driving roller 131 and the pressing roller 121 is made substantially straight. In this embodiment, the driving roller 131 is formed in a normal crown shape of 300 μm.

Further, the pressing cam shaft 307 is rotated to the second angular position of rotation and is stopped, so that the largely protruded portion of the eccentric pressing cam 308 is directed downward and a small protruded portion corresponds to the lower surface of the lower frame to lower the lower-side belt assembly B. That is, the pressure of the lower-side belt assembly B to the upper-side belt assembly A is eliminated and is held at the spaced position from the upper-side belt assembly A in a non-contact and predetermined spaced manner as shown in FIG. 5.

Figure 8:
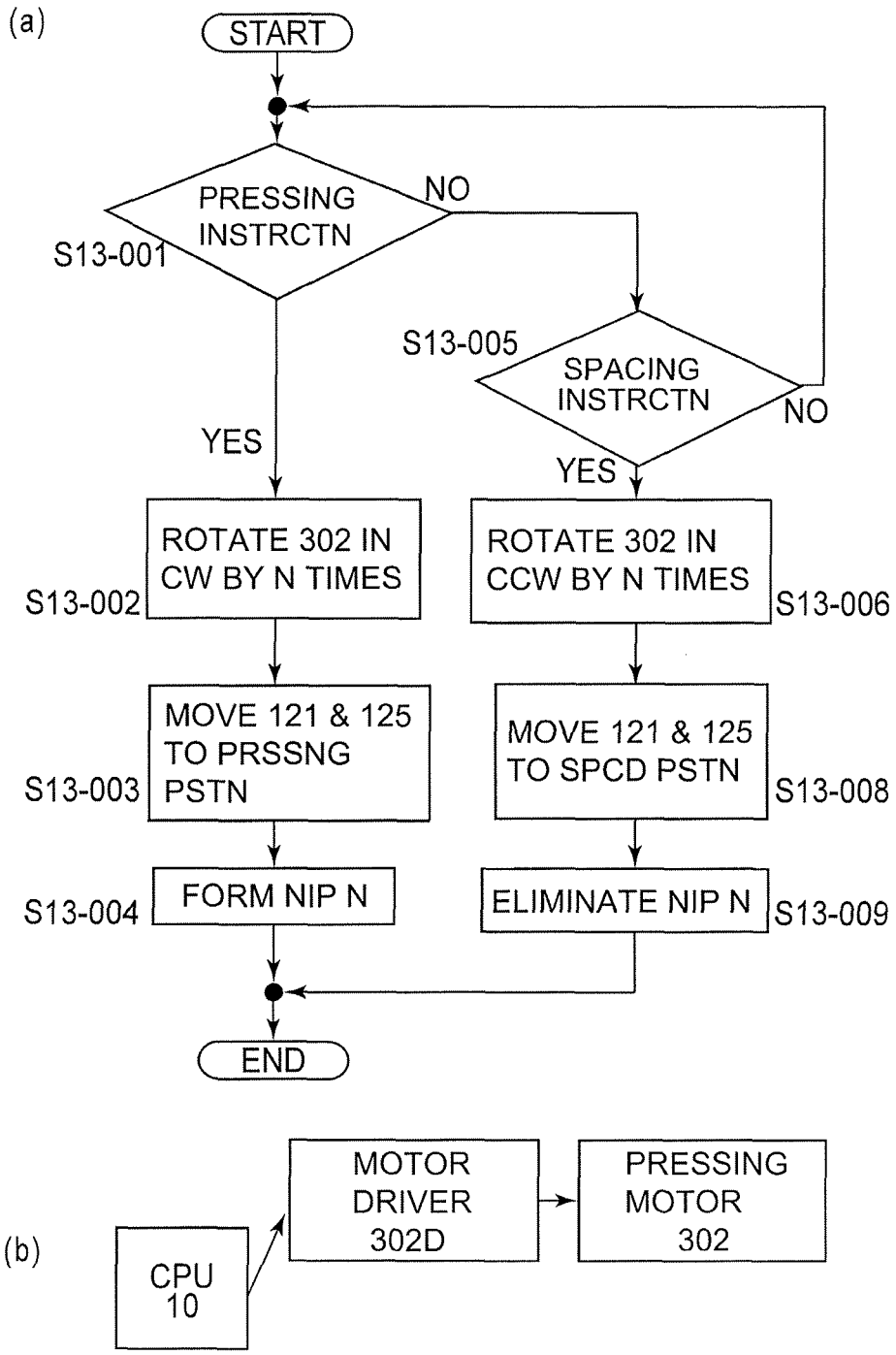
In FIG. 8, (a) is a flowchart of vertical movement control of the lower-side belt assembly B, and (b) is a block diagram of a control system.

Here, by a control flowchart of (a) of FIG. 8 and a block diagram of a control system of (b) of FIG. 8, vertical movement control of the lower-side belt assembly B will be described. The lower-side belt assembly B is usually held at the spaced position shown in FIG. 5. By a pressing instruction from the CPU 10 <S13-001>, the pressing motor 302 rotates in a CW direction by N turns, which is a predetermined number of rotation <S13-002>, so that the pressing cam shaft 307 is driven a half turn.

As a result, the eccentric pressing cam 308 is changed in angular position from the second angular position of rotation of FIG. 5 to the first angular position of rotation of FIGS. 4 and 6, so that the lower-side belt assembly B is raised and rotationally moved, and the pressing roller 121 and the pressing pad 125 move to the pressing position <S13-002>. That is, the pressing roller 121 and the pressing pad 125 press-contact the pressing belt 120 toward the driving roller 131 and the pad stay 137 of the upper-side belt assembly A via the fixing belt 105 at a predetermined contact pressure. As a result, between the fixing belt 105 and the pressing belt 120, the fixing nip N having a predetermined width with respect to the sheet feeding direction V is formed <S13-004>.

Further, in a state in which the lower-side belt assembly B is usually held at the spaced position shown in FIG. 5, by a pressing instruction from the CPU 10 <S13-005>, the pressing motor 302 rotates in a CCW direction by N turns, which is a predetermined number of rotation <S13-006>. As a result, the pressing cam shaft 307 is driven a half turn, so that the eccentric pressing cam 308 is changed in angular position from the first angular position of rotation of FIGS. 4 and 6 to the second angular position of rotation of FIG. 5. That is, the lower-side belt assembly B is raised and rotationally moved, so that the pressing roller 121 and the pressing pad 125 move to the spaced position <S13-008>. As a result, the formation of the fixing nip N is eliminated <S13-009>.

3) Fixing Operation and Temperature Control

A fixing operation of the fixing device 100 will be described with reference to a control flow chart of (a) of FIG. 10 and a block diagram of a control system of (b) of FIG. 10. During a stand-by state of the fixing device 100, the lower-side belt assembly B is held at the spaced position of FIG. 5. The drive of the driving motor 301 is stopped, and electric energy supply to the IH heater 170 is also stopped.

The CPU 10 starts predetermined image forming sequence control on the basis of input of a print job start signal. With respect to the fixing device 100, at a predetermined control timing, the pressing motor 302 is driven via a motor driver 302D, and the pressing cam shaft 307 is driven a half turn, so that the lower-side belt assembly B is moved from the spaced position of FIG. 5 to the pressing position of FIG. 4. As a result, the fixing nip N is formed between the fixing belt 105 and the pressing belt 120 <S16-001>.

Next, the CPU 10 drives the driving motor 301 via a motor driver 301D to input the driving force into the drive input gear G. As a result, the driving roller 131 of the upper-side belt assembly A is driven as described above to start rotation of the fixing belt 105.

Further, a rotational force of the drive input gear G (FIG. 6) is transmitted to also the pressing belt 120 of the lower-side belt assembly B via a driving gear train (not shown), so that the pressing roller 121 is rotationally driven in the counterclockwise direction of an arrow in FIG. 4. With the rotation of the pressing roller 121 and by a frictional force with the rotating fixing belt 105, rotation of the pressing belt 120 is started in the counterclockwise direction of an arrow in FIG. 4 <S16-002>. The movement directions of the fixing belt 105 and the pressing belt 120 are the same at the fixing nip N and moving speeds thereof are also substantially the same.

Figure 10:
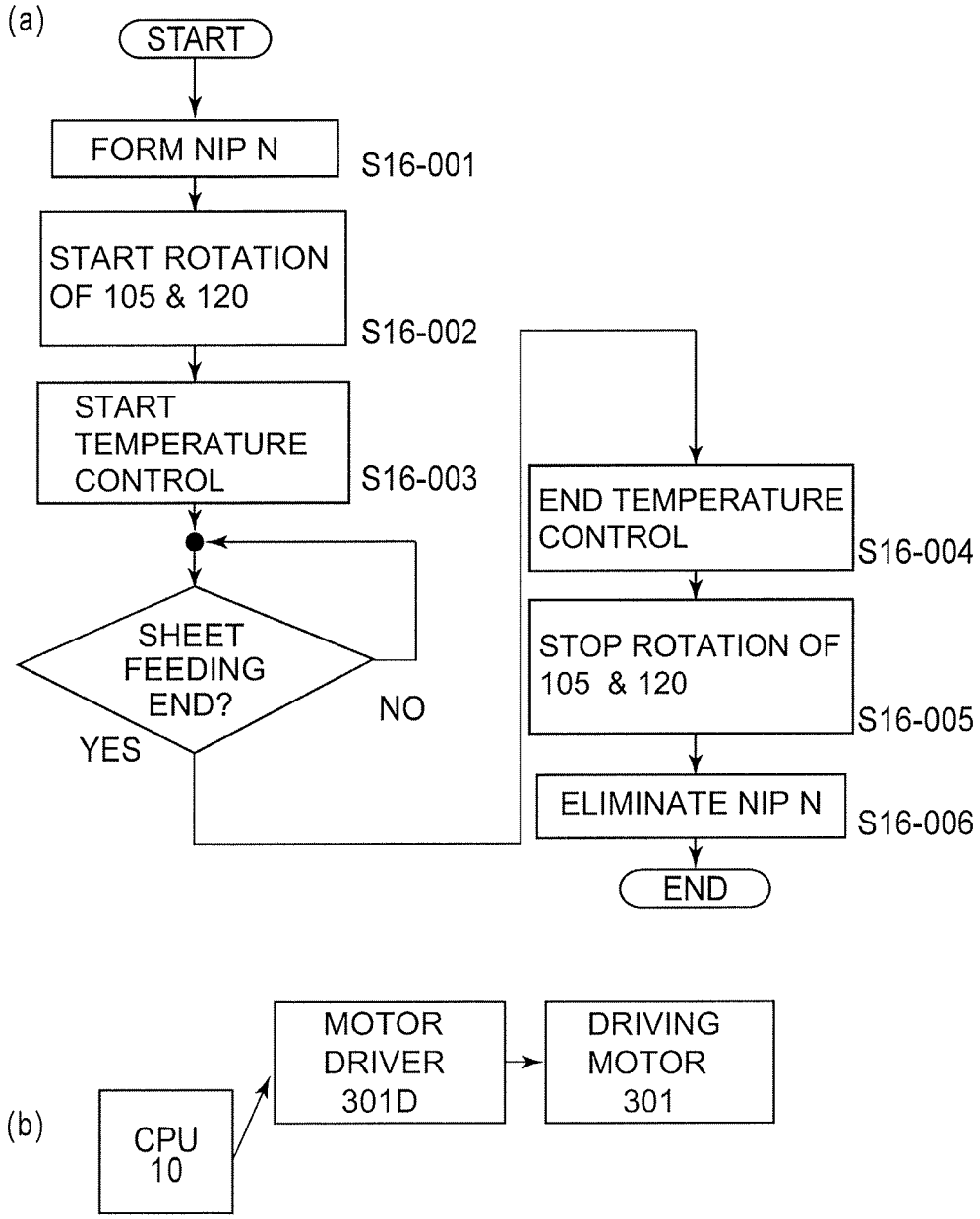
In FIG. 10, (a) is a fixing operation control flowchart, and (b) is a block diagram of a control system.

Next, the CPU 10 supplies electric power to the IH heater 170 via a heater controller 170C ((b) of FIG. 10) and a heater driver 170D to heat the rotating fixing belt 105 through electromagnetic induction heating, thus raising the fixing belt temperature to a predetermined target temperature to effect temperature control. That is, the CPU 10 starts the temperature control such that the temperature of the fixing belt 105 is raised to the target temperature ranging from 140° C. to 200° C. depending on a basis weight or type of the sheet S to be passed through the fixing device 100, and then is maintained at the target temperature <S16-003>.

Then, in a state in which the formation of the fixing nip N, the rotation of the fixing belt 105 and the pressing belt 120, and the temperature raising and temperature control of the fixing belt 105 are effected, the sheet S on which surface the unfixed toner image t (FIG. 4) is formed is guided from the image forming station into the fixing device 100. The sheet S is guided by an entrance guide 184 provided at a sheet entrance portion of the fixing device 100 to enter the fixing nip N which is the press-contact portion between the fixing belt 105 and the pressing belt 120. The entrance guide 184 is provided with a flag sensor 185 including a photo-interrupter, so that the flag sensor 185 detects passing timing of the sheet S.

The sheet S opposes the fixing belt 105 at its image-carrying surface and opposes the pressing belt 120 at its surface opposite from the image-carrying surface, and in this state, the sheet S is nipped and fed at the fixing nip N. Then, the unfixed toner image t is fixed as a fixed image on the sheet surface by heat of the fixing belt 105 and the nip pressure. The sheet S having passed through the fixing nip N is separated from the surface of the fixing belt 105 and comes out of the fixing device 100 from the sheet exit side, and then is fed and discharged onto a discharge tray 21 by a discharging roller pair 20 (FIG. 1).

Then, when the feeding of the sheet S in the print job of a predetermined single sheet or a plurality of successive sheets is ended, the CPU 10 ends the heating and temperature control of the fixing belt 105 and turns off the power supply to the IH heater 170 <S16-004>. Further, the driving motor 301 is turned off to stop the rotation of the fixing belt 101 and the pressing belt 120 <S16-005>.

Further, the CPU 10 drives the pressing motor 302 via the motor driver 302D to the pressing cam shaft a half turn, so that the lower-side belt assembly B is moved from the pressing position of FIG. 4 to the spaced position of FIG. 5. By this, the fixing nip N between the fixing belt 105 and the pressing belt 120 is eliminated <S16-006>. In this state, the CPU 10 waits for input of a subsequent print job start signal.

Here, by a control flow chart of (a) of FIG. 9 and a block diagram of a control system of (b) of FIG. 9, temperature control of the fixing belt 105 will be described. In the upper-side belt assembly A, a thermistor 220 as a temperature detecting member for detecting the surface temperature of the fixing belt 105 is provided. The CPU 10 supplies the electric power to the IH heater 170 via the heater controller 170C and the heater driver 170D at predetermined control timing on the basis of the input of the print job start signal <S17-001>. The fixing belt 105 is heated in temperature through the electromagnetic induction heating by the IH heater 170.

The temperature of the fixing belt 105 is detected by the thermistor 220, and detection temperature information (electrical information on the temperature) is inputted into the CPU 10. The CPU 10 stops the supply of the electric power to the IH heater 170 when the detection temperature by the thermistor 220 is not less than a predetermined value (target temperature). Thereafter, the CPU 10 resumes, when the detection temperature by the thermistor 220 is lower than the predetermined value <NO of S17-004>, the supply of the electric power to the IH heater 170 is resumed <S17-001>.

By repetition of the above-described steps <S17-001> to <S17-004>, the fixing belt 105 is temperature-controlled and kept at the predetermined target temperature. Then, the above fixing belt temperature control is executed until the print job of the predetermined single sheet or the plurality of successive sheets is ended <S17-005>.

4) Belt Shift Control Mechanism

The fixing belt 105 generates a phenomenon that in a rotation process thereof, the fixing belt 105 moves so as to shift toward one side or the other side with respect to a widthwise direction perpendicular to the sheet feeding direction V (shift movement of the belt). Also the pressing belt 120 forming the fixing nip N in press-contact with the fixing belt 105 shifts and moves together with the fixing belt 105.

In this embodiment, this shift movement of the fixing belt 105 is stabilized within a predetermined shift range by swing-type shift control. The swing-type shift control is such a method that in the case where movement of a belt position from a widthwise central portion by a predetermined amount is detected, the steering roller 132 is tilted in an opposite direction to the shift movement direction of the fixing belt 105. By repeating this swing-type shift control, the fixing belt 105 periodically moves from one side to the other side in the widthwise direction, and therefore the shift movement of the fixing belt 105 can be controlled stably. That is, the fixing belt 105 is constituted so as to be reciprocable in the direction perpendicular to the feeding direction V of the sheet S.

In the upper-side belt assembly A, at a position toward the steering roller 132 on the left side (front side) of the fixing belt 105, a sensor portion (not shown) for detecting a fixing belt end portion position is provided. The CPU 10 detects the end portion position (belt shift movement position) of the fixing belt 105 by this sensor portion, and depending on that, rotates the stepping motor 155 in the normal rotational direction (CW) or the reverse rotational direction (CCW) by a predetermined number of rotations.

By this, via the above-described mechanisms 157, 152, 161, 151 of FIGS. 5 and 6, the left-side steering roller supporting arm 154 rotationally moves about the shaft 131*a* upward or downward by a predetermined control amount. In interrelation with this, a tilt of the steering roller 132 changes, so that the shift control of the fixing belt 105 is effected.

5) Fixing Belt Roughening Mechanism

Next, a roughening mechanism (surface property refreshing mechanism) for performing surface property refreshing of the fixing belt 105 will be described using FIG. 1. In this embodiment, above the driving roller 131 of the upper-side belt unit A, a pressing roller 400 as a rotatable rubbing member (roughening member) for refreshing (restoring) the surface property of the fixing belt 105 by rubbing (roughening) an outer surface of the fixing belt 105 by abrading (rubbing) an outer surface of the fixing belt 105 is provided.

This roughening roller is, as described above, effective in the case where a portion of the fixing belt contacting the edge portion at each of the widthwise ends of the sheet is partly roughed at the surface thereof compared with another portion.

That is, the roughening roller rubs the fixing belt over substantially an entire region with respect to the longitudinal (widthwise) direction, whereby a surface roughness is made substantially the same between a portion where the surface is partly roughened and a portion where the surface is not partly roughened, so that a deterioration state is made inconspicuous. In this manner, the deterioration state is made inconspicuous, in this embodiment, because the surface property is refreshed (restored). Specifically, in this embodiment, the surface of the fixing belt partly roughened to have a surface roughness Rz (according to JIS standard) of about 2.0 is restored to the surface roughness Rz of 0.5 or more and 1.0 or less by a rubbing process (rubbing process) by such a roughening roller.

At this time, in the case where a difference in surface roughness Ra (according to JIS standard) between the portion of the fixing belt contacting the sheet edge portion and another portion is ΔRa, the process is performed so that ΔRa is changed from a state of about 0.3 to about 0.1 by the roughening process (rubbing process). In this way, in this embodiment, although the roller is called the roughening roller, the function of the roughening roller is that the surface roughness of the fixing belt 105 is maintained in a sufficiently low state for a long term. This leads to suppression of a lowering in glossiness of the image while suppressing uneven glossiness of the image.

The roughening roller 400 is rotatably supported via bearings (not shown) between a pair of left and right RF supporting arms 141 rotatably supported by a fixing shaft 142 fixed coaxially with each of the left and right upper-side plates 140 of a device casing. The roughening roller 400 is prepared by closely bonding abrasive grain toward a surface of a core metal formed of a stainless steel in 12 mm in diameter via an adhesive layer.

As the abrasive grain, the abrasive grain of #1000-#4000 in count (grain size) may preferably be used depending on a target glossiness of the image. An average particle size of the abrasive grain is about 16 μm in the case where the count (grain size) is #1000 and is about 3 μm in the case where the count (grain size) is #4000. The abrasive grain is alumina-based abrasive grain (popularly called "Alundum" or "Morundum"). The alumina-based abrasive grain is the abrasive grain which is industrially used most widely, and is remarkably high in hardness compared with the surface of the fixing belt 105. The alumina-based abrasive grain is also excellent in abrasiveness since particles thereof have an acute shape. In this embodiment, the abrasive grain (7 μm in average particle size) of #2000 in count (grain size) is used.

Incidentally, in this embodiment, as the roughening roller 400, the roller prepared by closely bonding the abrasive grain toward the stainless steel-made core metal via the adhesive layer was described. However, the roughening roller 400 is not limited thereto, but may also be a roller obtained by subjecting the surface of the stainless steel-made core metal to blasting or the like to be uniformly (surface-)treated so that Ra is 1.0 or more and 5.0 or less, and is preferably 2.0 or more and 4.0 or less.

6) Contact-and-Separation Mechanism for Causing Roughening Roller to Contact and Separate In this embodiment, a contact-and-separation mechanism (moving mechanism) for moving the roughening roller toward and away from the fixing belt is provided. That is, the contact-and-separation mechanism for contacting the roughening roller with the fixing belt during an operation (of the rubbing process) while spacing (separating) the roughening roller from the fixing belt during a non-operation of the rubbing process is provided.

In the following, the contact-and-separation mechanism will be described specifically by FIG. 1A and FIG. 1B. The roughening roller is constituted so that shaft portions at longitudinal end portions of the roughening roller are pressed toward the fixing belt by a pressing mechanism. In this embodiment, the left and right RF supporting arms 141 (FIG. 1A), described later, perform the function of this pressing mechanism. On an upper side of the left and right RF supporting arms 141, PF cams (eccentric cams) 407 (FIG. 1B) as the moving mechanism for moving the roughening roller toward and away from the fixing belt are provided, respectively.

Here, the left and right RF cams 407 are fixed to an RF cam shaft 408 (FIG. 1A) rotatably shaft-supported between the left and right upper-side plates 140 (FIG. 1A) of the device casing in the same shape with the same phase. RF spacing springs 405 (FIG. 1A) are stretched and disposed between arm end portions of the left and right RF supporting arms 141 in an opposite side from a side where the roughening roller is supported and the RF spacing shafts 406 are fixed and secured to the left and right upper-side plates 140.

Figure 1A:
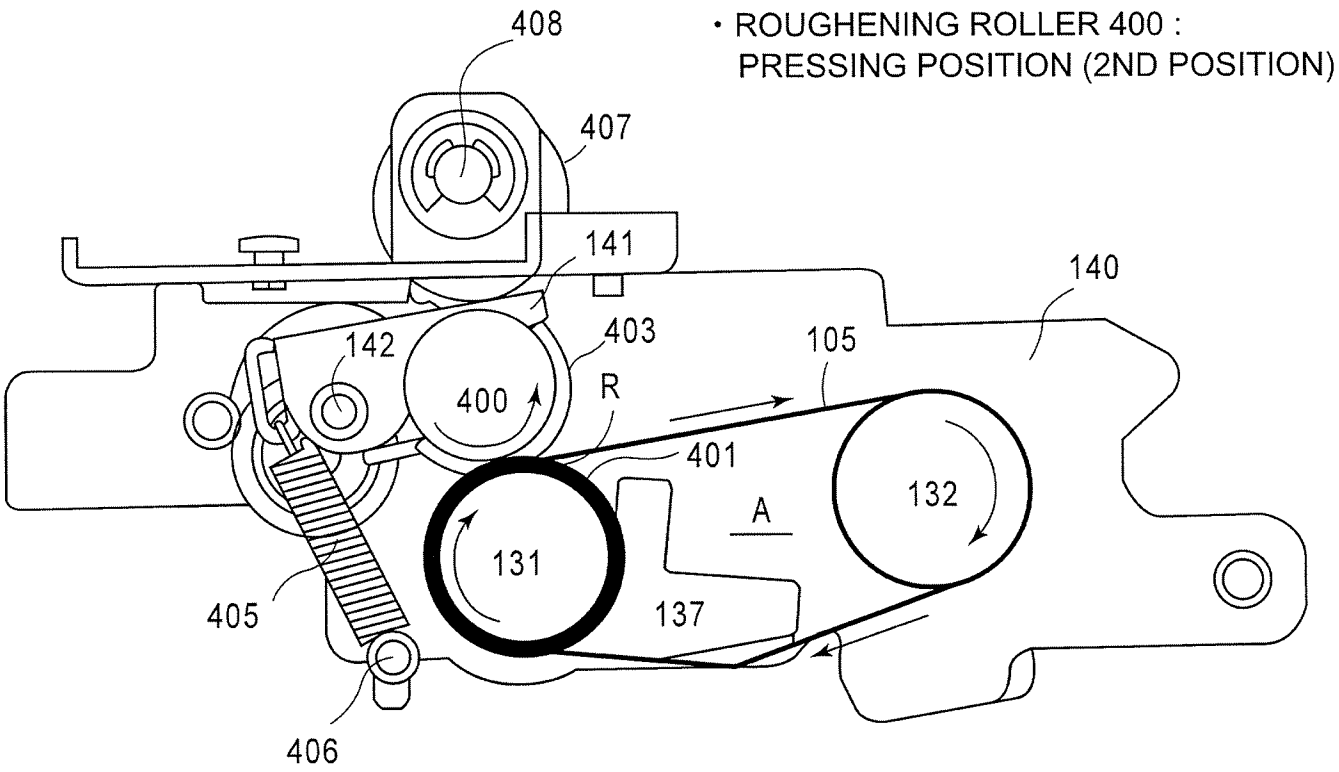
FIG. 1A is a cross-sectional right side view during a pressing state of a lower-side belt assembly B) of a principal part of a fixing device.
Figure 1B:
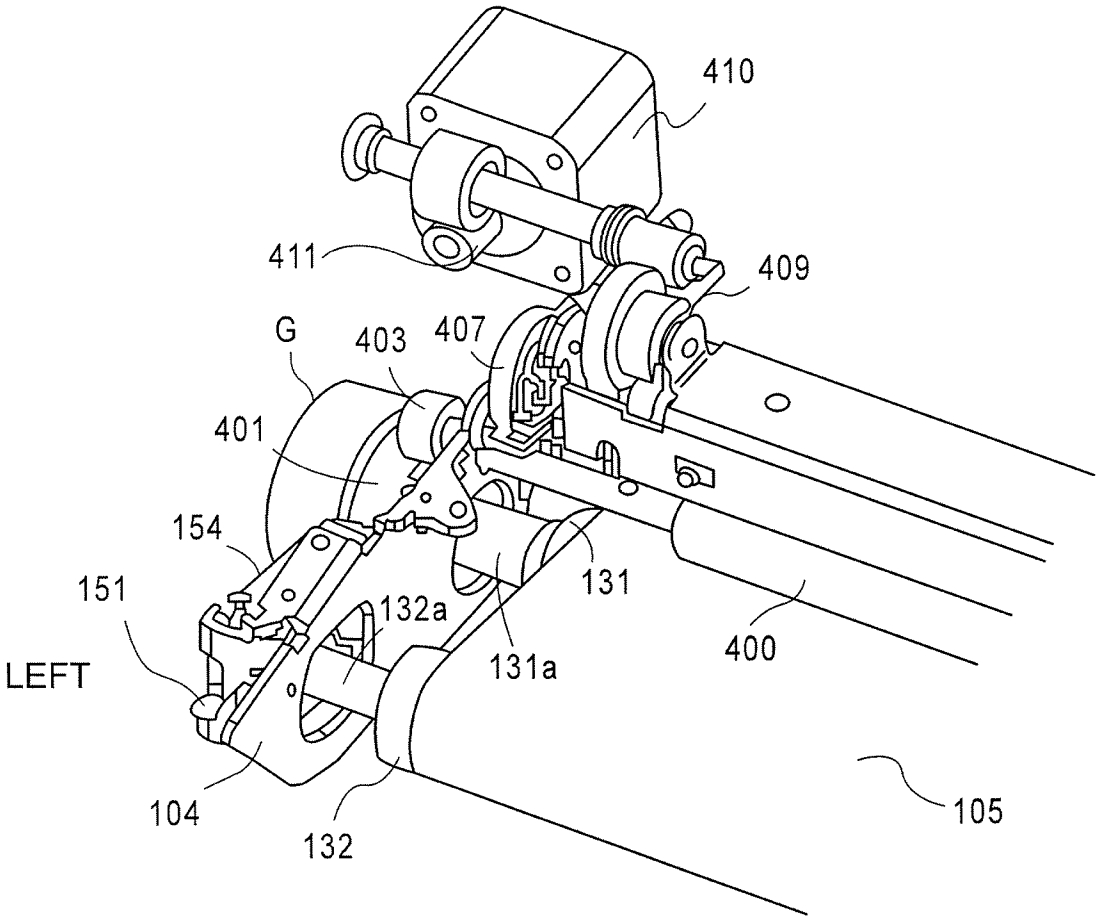
FIG. 1B is a perspective view of a roughening mechanism (surface property refreshing mechanism).

By tension of this RF spacing spring 405, the left and right RF supporting arms 141 are always rotated and urged about the fixing shaft 142 in a direction of raising the roughening roller 400, so that the upper arm surface is elastically pressed against the lower surface of the corresponding one of the refreshing cams 407 (FIG. 1B). Further, at a right side end portion of the RF cam shaft 408, an RF mounting and demounting gear 409 (FIG. 1B) is fixed. With this RF mounting and demounting gear 409, an RF motor gear 411 of an RF motor 410 engages.

In this embodiment, the left and right RF cams 407 usually stop in a first attitude having an angle of rotation where the largely protruded portion is directed upward as shown in FIGS. 4 and 5. During this state, the left and right RF supporting arms 141 correspond to the small protruded portions of the corresponding RF cams 407. For that reason, the roughening roller 400 is held at the spaced position spaced from the fixing belt 105 in a predetermined state. That is, the roughening roller 400 is raised above the fixing belt 105 and does not act on the fixing belt 105.

The left and right RF cams 407 are rotated 180 deg. from the above-mentioned first attitude and are changed in attitude to a second attitude having an angle of rotation where the largely protruded portion is directed downward, as shown in FIG. 1A, and are held in the second attitude. During this state, the left and right RF supporting arms 141 are pressed down about the fixing shaft 142 against the RF spacing springs 405 by the corresponding RF cams 407. Then, the roughening roller 400 contacts (abuts) the surface of the fixing belt 105 with a predetermined pressure at a belt extending portion of the driving roller 131, and is changed and held in position to the pressing position (contact position) where a roughening nip R is formed.

Further, an RF gear 403 fixed to an end portion of the roughening roller 400 engages with an RF driving gear 401 fixed to an end portion of the driving roller 131. By this, a rotational force of the driving roller 131 is transmitted to the roughening roller 400 via the RF driving gear 401 and the refreshing gear 403, so that the roughening roller 400 rotates in an opposite direction to the rotational direction of the fixing belt 105. That is, the roughening roller 400 provided with a rubbing layer at the surface thereof rotates in a width direction (a direction in which their surfaces move in the same direction) with a perpendicular speed difference relative to the fixing belt 105, and has the function of uniformly roughening the surface of the fixing belt 105 (surface smoothing function).

That is, the roughening roller 400 which is a rubbing member, is a roller member rotating with the peripheral speed difference relative to the fixing belt 105. A positional change of the roughening roller 400 between the spaced position and the pressing position is made by changing the attitude of the left and right RF cams 407 between the first attitude and the second attitude as described above by the RF pressing motor 410 via the RF motor gear 411, the RF mounting and demounting gear 409 and the RF cam shaft 408. Incidentally, in FIG. 1A, the lower-side belt unit belt forming the fixing nip N by being pressed against the upper-side belt unit A is omitted.

Here, during the rubbing process of the fixing belt 105 (upper-side belt unit A) by the roughening roller 400, the lower-side belt unit B is not limited to the case where the lower-side belt unit B is in a contact state with the upper-side belt unit A, but may also be in a spaced state from the upper-side belt unit A.

Figure 11:
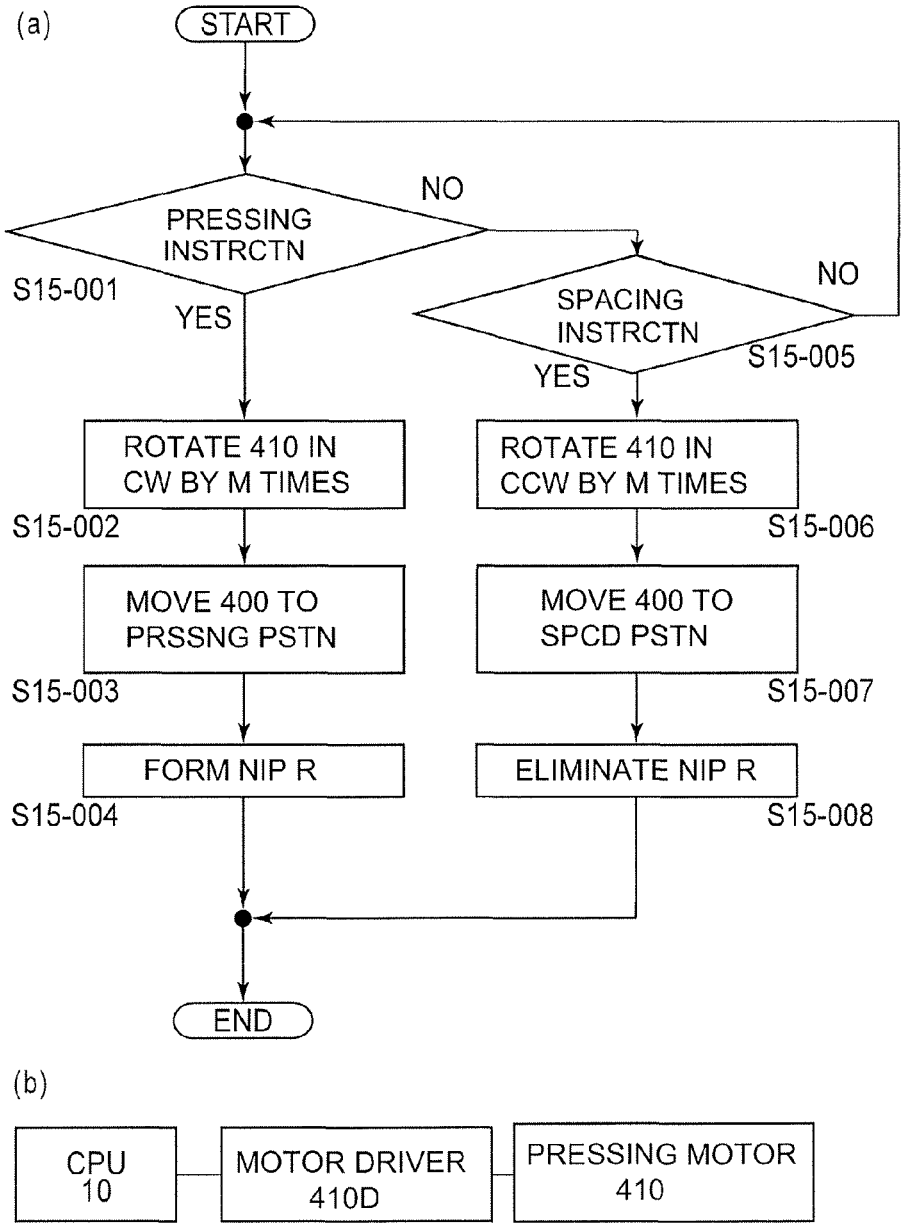
In FIG. 11, (a) is a control flowchart of a roughening mechanism, and (b) is a block diagram of a control system.

In FIG. 11, (a) is an operation control flowchart of the above-mentioned roughening mechanism. The left and right RF cams 407 of the roughening mechanism are, as described above, usually stopped in the first attitude having the angle of rotation where the largely protruded portion is directed upward as shown in FIGS. 4 and 5. That is, the roughening roller 400 is usually held at the spaced position in which the roughening roller 400 is spaced from the fixing belt 105 in a predetermined state.

The CPU 100 rotates, at predetermined pressing control timing <S15-001: pressing instruction>, the RF motor 410 in a CW direction by M turns, which is a predetermined number of rotation rotations by the motor driver 410D <S15-002>. As a result, the left and right RF cams 407 are changed in attitude from the first attitude (FIGS. 4 and 5) to the second attitude (FIG. 1A), so that the roughening roller 400 is moved from the spaced position (first position) to the pressing position (second position) <S15-003>. By movement of the roughening roller 400 to the pressing position, the fixing belt 105 and the roughening roller 400 press-contact each other, so that the roughening nip R is formed <S15-004>.

Then, the CPU 100 rotates, at predetermined spacing control timing <S15-005: spacing instruction>, the RF motor 410 in a CCW direction by M turns, which is a predetermined number of rotations by the motor driver 410D <S15-006>. As a result, the left and right RF cams 407 are returned in attitude from the second attitude (FIG. 1A) to the first attitude (FIGS. 4 and 5), so that the roughening roller 400 is moved from the pressing position to the spaced position <S15-007>. By movement of the roughening roller 400 to the pressing position, the roughening nip R where the fixing belt 105 and the roughening roller 400 press-contacted each other is eliminated <S15-008>.

As described above, the roughening roller 400 contacts the fixing belt 105 and forms the roughening nip R, so that the roughening roller 400 rotates. By this, refreshing of the surface property of the fixing belt 105 is made, but in a process in which the roughening process (rubbing process) is made, shavings (cuttings) of the surface fixing belt layer can generate at the pressing nip. Here, the generated shavings accumulate at the roughening nip and gradually impair a roughening effect and thus can lower an efficiency of the roughening process (rubbing process).

In order to prevent the lowering in efficiency of the roughening process (rubbing process) by the shavings on the fixing belt surface layer generated by this roughening roller, during a series of operations of the roughening process (rubbing process), the roughening roller 400 is repetitively reciprocated a plurality of times between the pressing position and the spaced position as described below.

Figure 12:
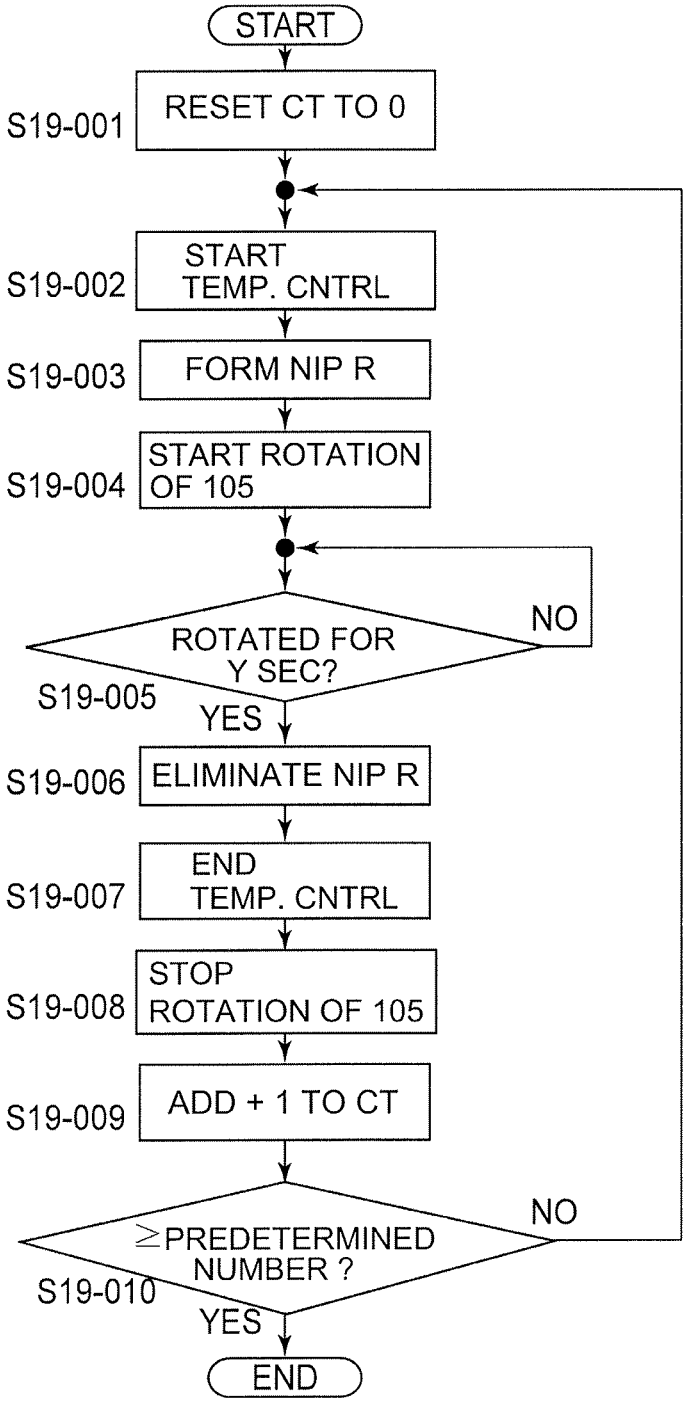
FIG. 12 is a surface property refreshing operation flowchart.

In the following, this series of operations of the roughening process (rubbing process) will be described using FIG. 12. When the roughening process (rubbing process) is started, a roughening operation counter CT is reset to 0, and a value of the roughening operation counter CT is stored in a memory Z <S19-001>. Then, a temperature of the fixing belt 105 is controlled to a temperature for performing the roughening process (rubbing process) by the IH heater 170 <S19-002>. The temperature control at this time is executed in accordance with the flowchart of FIG. 9.

When the temperature control is started, the roughening roller 400 is press-contacted to the fixing belt 105, so that the roughening nip R is formed <S19-003>. Here, formation of the roughening nip R is made by <S15-001>-<S15-004> of FIG. 11. Then, the roughening process is performed for a predetermined time Y sec (In this embodiment, a contact time is 3 sec) while rotating the fixing belt 105<S19-005>.

After the rotation for Y sec, a rest process is performed. Specifically, the roughening roller is moved to the spaced position (in this embodiment, a spacing time is 5 sec, i.e., movement between the both positions requires 3 sec), so that the roughening nip R is eliminated <S19-006>, and the temperature control by the IH heater 170 is ended and the fixing belt 105 is stopped. Here, the elimination of the roughening nip R is made by <S15-005>-<S15-008> of FIG. 11.

Figure 13:
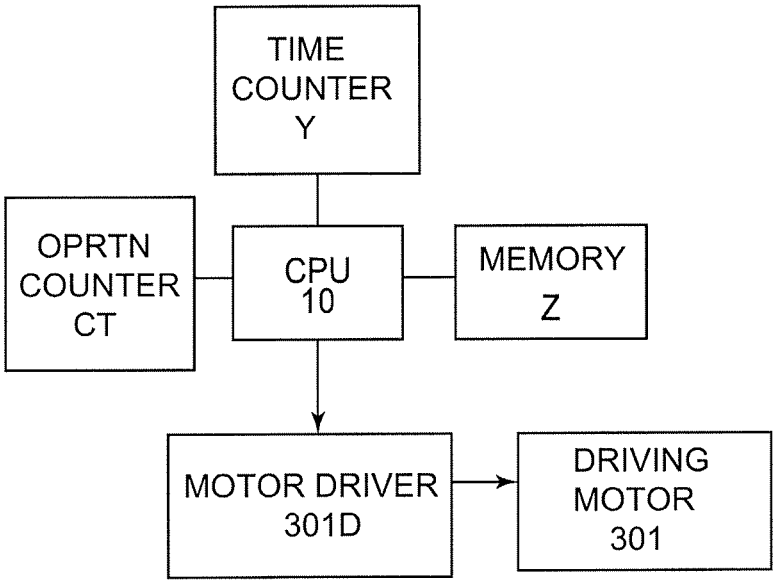
FIG. 13 is a block diagram of a control system.

Then, as shown in FIG. 13, +1 is added to the value of the roughening operation counter CT stored in the memory Z, and a first roughening operation is ended <S19-009>. Here, <S19-002>-<S19-009> are repetitively performed (7 times in this embodiment) until a present value of the roughening operation counter CT is a predetermined value. That is, in this embodiment, during the rubbing process, an operation of contact for 3 sec as the roughening process and an operation of spacing for 5 sec as the rest process performed after the contacting operation are repeated a plurality of times. The above operations are the series of operations of the roughening process (rubbing process), and by this series of operations of the roughening process (rubbing process), improvement in refreshing efficiency of the surface property can be achieved. That is, in a single step of the rubbing process, the roughening roller 400 is contacted to the fixing belt 105 for 21 sec (3 sec×7 times) in total.

In this embodiment, the series of operations of the roughening process (roughness) including the press-contact and spacing operation times of the roughening roller 400 is controlled so as to be completed in 60 sec (the pressing roller 400 is contacted in 3 sec, and the roughening process and the rest process are repeated 6 times, and finally the roughening process is executed for 3 sec and the operation is ended). Here, a comparison of a surface property refreshing effect for the fixing belt 105 in the case where the operation in which the roughening roller 400 is contacted to the fixing belt 105 for 3 sec and thereafter is spaced from the fixing belt 105 for 6 sec is performed a plurality of times as in this embodiment and in the case where the contact time is 30 sec is shown in FIG. 14.

Figure 14:
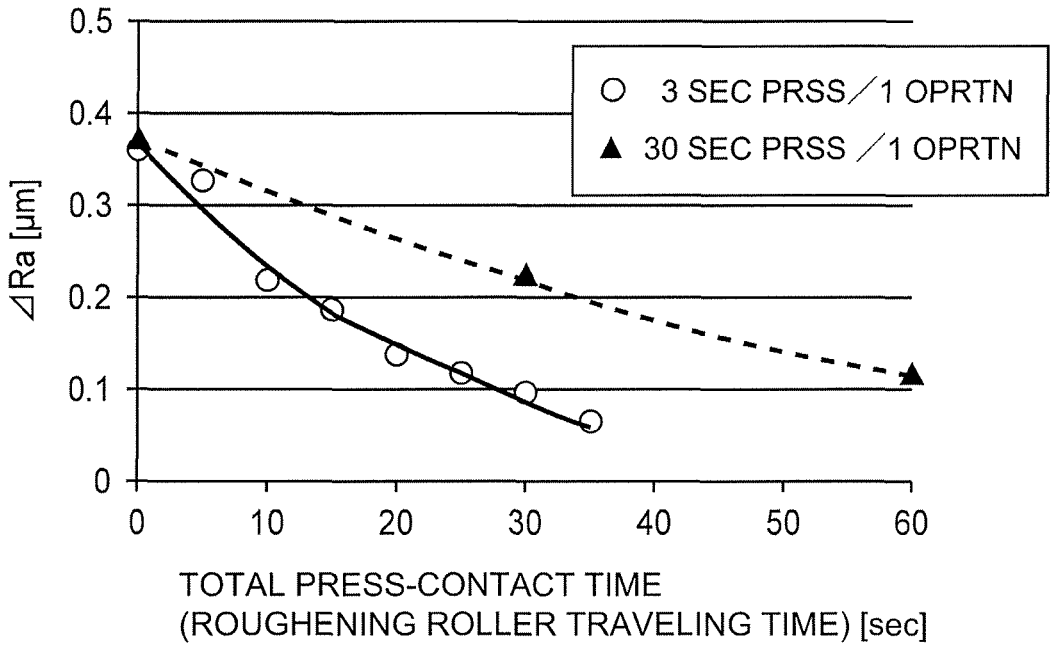
FIG. 14 is a surface property refreshing effect illustration according to a number of times of contact and separation of a roughening roller.

In FIG. 14, the abscissa is a total time (roughening roller traveling time) which is a cumulative value of the contact (press-contact) time of the roughening roller 400 with the fixing belt 105, and the ordinate shows a difference ΔRa in surface roughness Ra between a portion of the fixing belt contacting the sheet edge portion and another portion. Here, as ARa is a small value, it means that a resultant state is a state in which the surface property is refreshed (restored). As a time in which the roughening roller 400 rotates in a state in which the roughening roller 400 contacts (press-contacts) the fixing belt 105 becomes long, the surface property refreshing effect lowers, and therefore by effecting the contact and spacing plural a plurality of times in a short time as in this embodiment, the refreshing of the surface property of the fixing belt 105 can be made more efficiently. Incidentally, the traveling time of the roughening roller is a total time in which the roughening roller contacted the fixing belt, and is also a value (for example, 21 sec for one and 210 sec for 10 times) corresponding to a number of times of the rubbing process.

Next, timing when the operation goes to the surface property refreshing operation for the fixing belt 105 by the roughening roller 400 will be described using (a) and (b) of FIG. 15. As shown in (b) of FIG. 15 which is a block diagram, in this embodiment, the CPU 10 counts a number of sheets S subjected to the fixing process (which is also a number of times of image formation) by the fixing device 100 in this embodiment, in execution of a print job by a counter W as a counting portion for counting the number of the sheets, and stores an integrated value thereof in the memory Z.

Then, in the case where the integrated value reaches a predetermined number N, the surface property refreshing operation for the fixing belt 105 by the roughening roller 400 is executed after an end of the print job being executed or by interrupting the execution of the print job (fixing process). When the surface property refreshing operation is ended, the integrated value stored in the memory Z is reset to 0. In the case where the print job is interrupted, the surface property refreshing operation for the fixing belt 105 is executed, and thereafter a remaining part of the print job is resumed.

In (a) of FIG. 15, the surface property refreshing operation flow is shown as follows. When the integrated value of a number of sheets subjected to passing (through the fixing device) is not less than a predetermined number N of sheets subjected to passing <S18-001>, the CPU 10 confirms the end of the print job being executed or temporarily interrupts the print job <S18-002>. Then, the CPU 10 starts the surface property refreshing operation <S18-003>. Further, the counter is reset to 0. When the surface property refreshing operation is ended, the operation is in a state waiting for a subsequent print job or in the state waiting for the subsequent print job after the interrupted printer job is resumed and the end thereof <S18-004>.

In this embodiment, for example, in a print job of A4-plain paper, a count value is integrated in the counter W every one sheet fixing process, and in the case where the integrated value reaches a value corresponding to 3000 sheets, the surface property refreshing process for the fixing belt 105 is executed. Incidentally, in the case where the integrated value reaches 3000 sheets during execution of the continuous image forming job, a constitution in which the surface property refreshing process is executed as soon as the continuous image forming job is ended is employed.

Further, depending on a basis weight of the sheet, assignment of weights to the count value is made, and for example, with respect to A4-sized thick paper of 200 gsm in basis weight, setting is made so as to execute the surface property refreshing operation every 2000 sheets.

That is, with respect to a certain threshold which acts as an execution trigger for the surface property refreshing operation for the fixing belt 105, the count value depending on the basis weight of the sheet is provided, and the count value is integrated in the counter W every execution of the one sheet fixing process. In this embodiment, as the count value of the thick paper of 200 gsm, a count value which is 1.5 times the count value of the plain paper is set, and these count values set in advance are integrated in the counter W every execution of the fixing process. Then, when the print job is ended in a state in which the value of the counter exceeds a certain threshold, the surface property refreshing process for the fixing belt 105 is executed.

Incidentally, at the time when the count value reaches the threshold during the execution of the print job, the execution of the print job is interrupted, and the surface property refreshing process may also be executed.

7) Temperature Setting in Roughening for Restoring Roughening Effect

As mentioned above, the roughening roller 400 press-contact the fixing belt 105 and forms the roughening nip R, and the refreshing of the surface property of the fixing belt 105 is made by rotating the roughening roller 400. However, as a time of rubbing rotation of the fixing belt 105 with the roughening roller 400 by the roughening process (rubbing process) (hereinafter, called a traveling time) goes, a roughening effect gradually lowers by the shavings of the fixing belt surface layer or by an abrasion deterioration of the roughening roller 400 itself. This will be described using FIG. 16.

Figure 16:
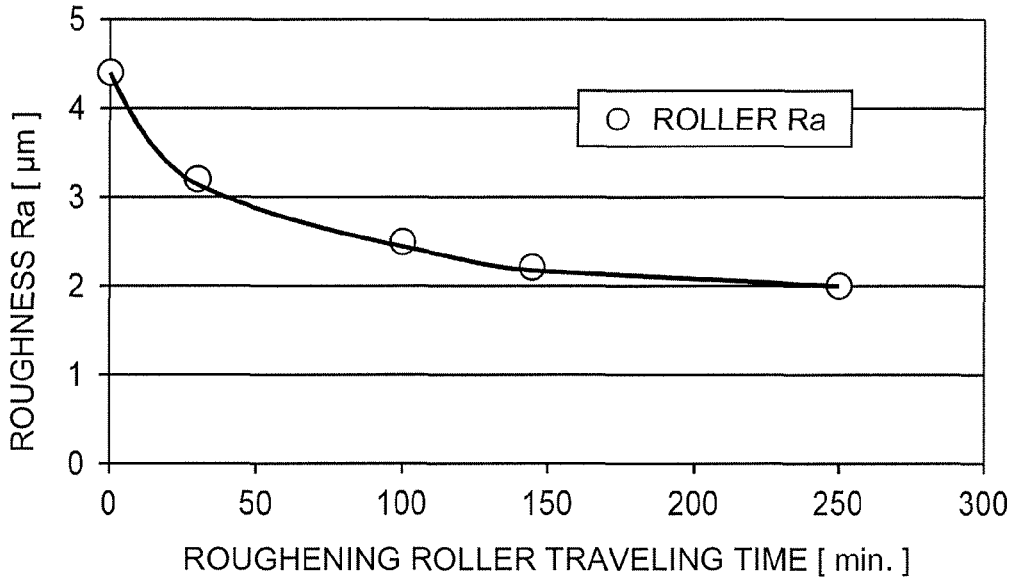
FIG. 16 is a progression illustration of a roughness Ra with a traveling time of the roughening roller.

FIG. 16 shows progression of the roughness Ra with a lapse of a traveling time of the roughening roller 400, wherein the surface roughness Ra of the roughening roller 400 is taken as the ordinate and the traveling time of the roughening roller 400 is taken as the abscissa. The surface roughness Rz of the roughening roller 400 (initial Ra is about 4.5 in this embodiment) which was enough to obtain the roughening effect at an initial stage of durability lowers with the lapse of the traveling time, so that there is a possibility that a sufficient roughening effect cannot be obtained (Ra of about 2.0 in this embodiment).

Figure 17:
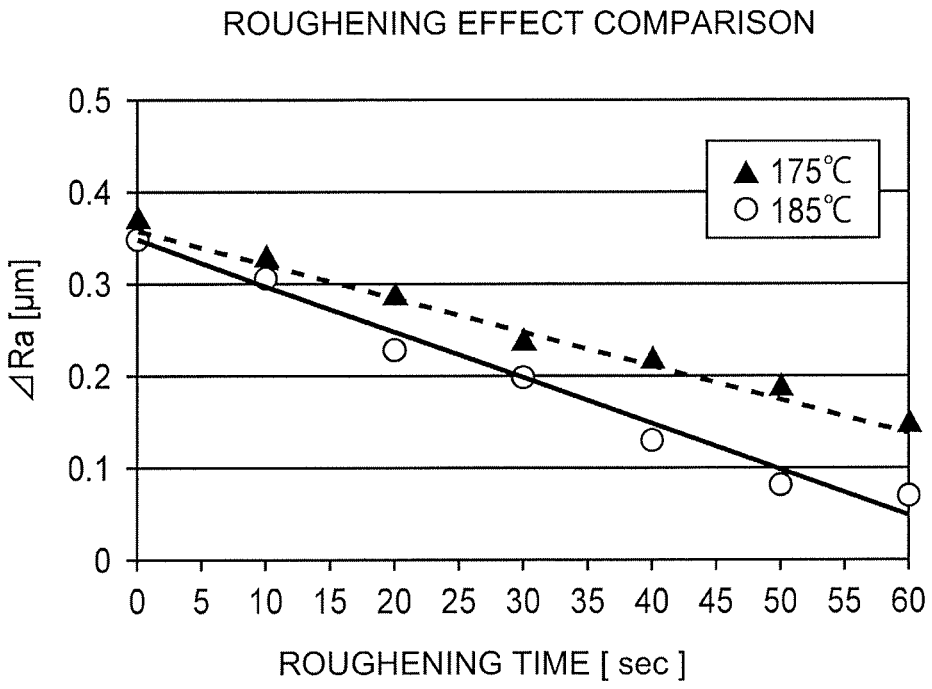
FIG. 17 is a surface property refreshing effect illustration according to (temperature) control temperatures during a roughening process.
Figure 18:
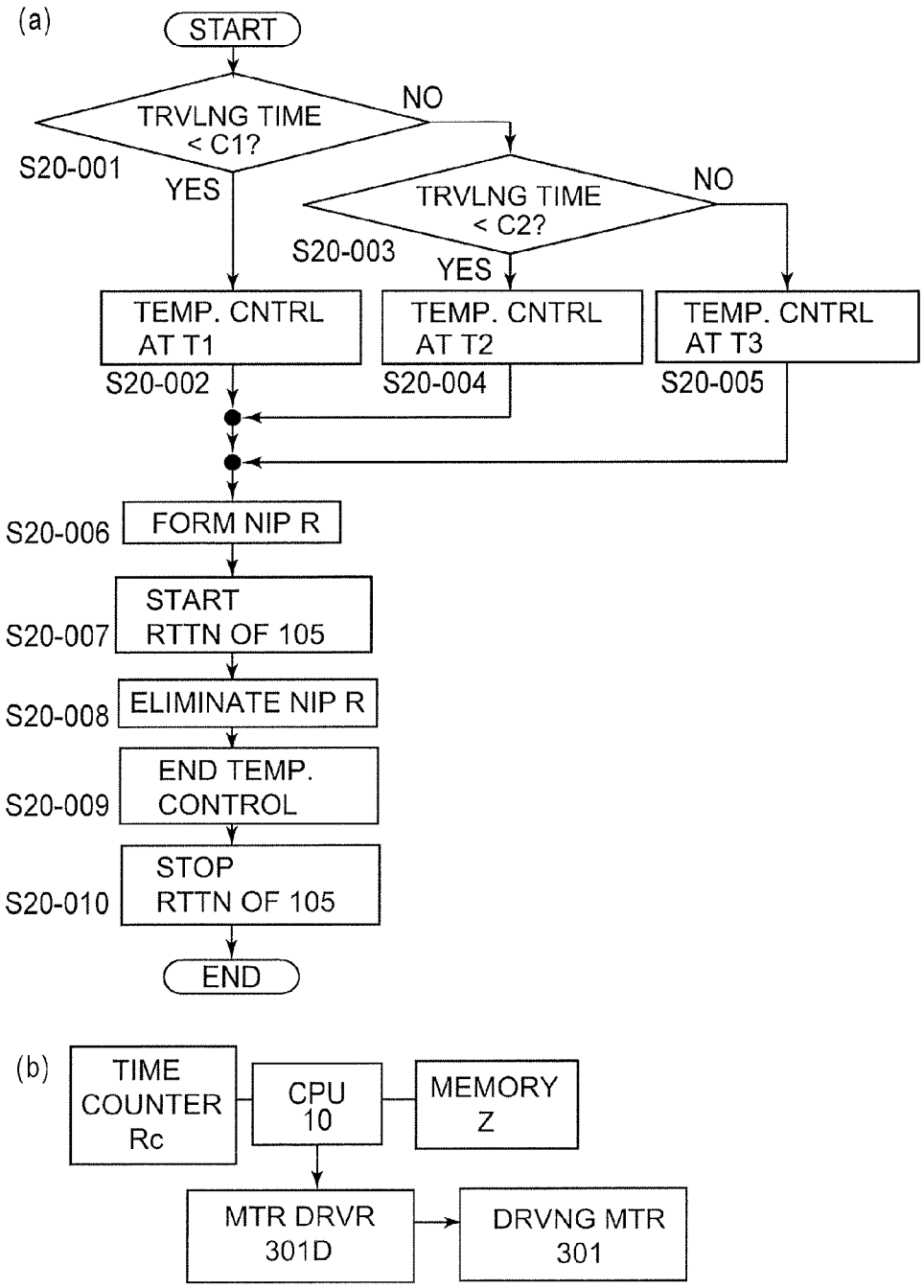
In FIG. 18, (a) is a surface property refreshing operation flowchart, and (b) is a block diagram of a control system.

In order to solve this, control is effected so that the temperature of the fixing belt 105 during the roughening process (rubbing process) is increased with a lapse of the traveling time of the roughening roller 400. This will be described using FIG. 17. The abscissa of FIG. 17 is a rubbing process time in which the roughening roller 400 rotates in a press-contact state with the fixing belt 105 and performs refreshing of the surface property of the fixing belt 105. The ordinate of FIG. 17 shows the difference ΔRa in surface roughness Ra between the fixing belt portion contacting the sheet edge portion and another portion, and means that the fixing belt is in a state in which the surface property is refreshed with a smaller value of ΔRa.

In the case where the roughening process (rubbing process) is performed in each of the case where the fixing belt 105 temperature during the rubbing process is 175° C. and the case of 185° C., a higher temperature by the IH heater 170 provides a higher surface property refreshing effect for the fixing belt 105 (assist of the lowering in roughening power). However, when the temperature is made high from an initial state in which the roughening effect is sufficiently obtained, abraded power (the shavings of the fixing belt surface layer) by the roughening roller 400 becomes large in amount and promotes the clogging of the roughening roller 400. For this reason, control is effected so that the roughening process (rubbing process) is performed by increasing the temperature of the fixing belt 105 with a lowering in surface roughness Ra (lowering in roughening power) of the roughening roller 400.

In the following, this roughening process (rubbing process) operation will be described using FIG. 20. When the roughening process (rubbing process) is started, the roughening roll traveling time (which is a cumulative time by a measuring portion for measuring a contact time with the fixing belt 105 as the first rotatable member and which corresponds to a cumulative tin of the rubbing process) stored in the memory Z of the CPU 10 is referred to. Incidentally, as described above, the cumulative time of the contact of the roughening roller with the fixing belt corresponds to the number of times the rubbing process is performed, and therefore the temperature of the fixing belt during the rubbing process may also be controlled depending on the number of times the rubbing process is performed. In this case, the value is stored in the memory Z while being counted up with every execution of the rubbing process. Then, the CPU 10 reads the number of the times stored in the memory Z, and effects the temperature control. That is, the CPU 10 controls the fixing belt temperature to a first temperature until the number of times of the rubbing process reaches a predetermined number, and controls the fixing belt temperature to a second temperature higher than the first temperature after the number of times the rubbing process is performed reaches the predetermined number. Incidentally, in the case where the time of the contact of the roughening roller with the fixing belt during the rubbing process is not constant, the temperature control on the basis of the rubbing time is preferably more than the temperature control on the basis of the number of times of the rubbing process.

If this is less than a certain value C1 (2100 sec in this embodiment), the fixing belt 105 is temperature-controlled to a temperature T1 (175° C. in this embodiment) by the IH heater 170 <S20-002>. If the roughening roller traveling time reaches C1 or more and less than C2 (6000 sec in this embodiment), the fixing belt 105 is temperature-controlled to a temperature T2 (180° C. in this embodiment) by the IH heater 170 <S20-004>.

If the roughening roller traveling time reaches C2 or more, the fixing belt 105 is temperature-controlled to a target temperature T2 (185° C. in this embodiment) by the IH heater 170 <S20-005>. That is, the control temperature is increased depending on an increase in cumulative time of the rubbing process (the target temperature of the fixing belt 105 is increased), or the surface temperature of the fixing belt 105 is changed from the controlled first temperature to the second temperature higher than the first temperature, so that the surface temperature is controlled.

Figure 9:
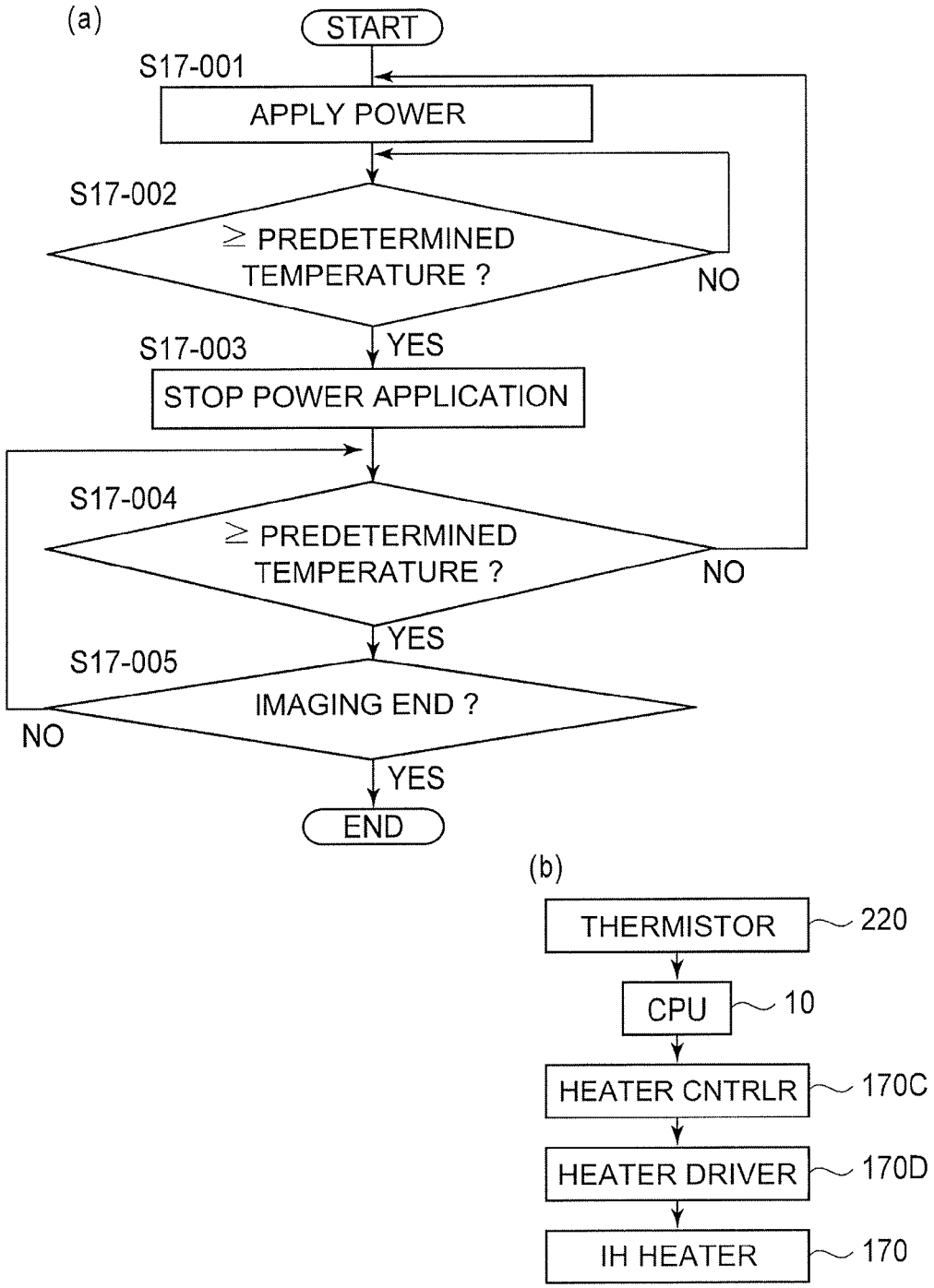
In FIG. 9, (a) is a fixing belt temperature control flowchart, and (b) is a block diagram of a control system.

The temperature control at this time is made in accordance with FIG. 9. When the temperature control is started, the roughening roller 400 is contacted (press-contacted) to the fixing belt 105, so that the roughening nip R is formed <S20-006>. Here, formation of the roughening nip R is made by <S15-001>-<S15-004> of FIG. 11. Then, the fixing belt 105 is rotated, and the roughening operation is performed (<S20-007> in this embodiment). The roughening operation time at this time is added to a traveling time counter Rc ((b) of FIG. 20), and is used for changing the control temperature of the fixing belt 105 during a subsequent roughening process (rubbing process) (in this embodiment, the roughening operation time is 60 sec).

When the roughening operation is performed for a predetermined time (60 sec in this embodiment), the roughening roller 400 is moved to the spaced position, so that the roughening nip R is eliminated <S20-008>, and the temperature control by the IH heater 170 is ended and the fixing belt 105 is stopped. Here, elimination of the roughening nip R is made by <S15-005>-<S15-008> of FIG. 11. By the roughening process (rubbing process) described above, the refreshing of the surface property of the fixing belt 105 can be performed.

Next, timing when the operation goes to the surface property refreshing operation for the fixing belt 105 by the roughening roller 400 will be described using (a) of FIG. 15. In this embodiment, as shown in (b) of FIG. 15 which is a block diagram, the CPU 10 counts a number of sheets S subjected to the fixing process by the fixing device 100, in execution of a print job by the counter W, and stores an integrated value thereof in the memory Z.

Then, in the case where the integrated value reaches a predetermined number N (3000 sheets in this embodiment), the surface property refreshing operation for the fixing belt 105 by the roughening roller 400 is executed after an end of the print job being executed or by interrupting the execution of the print job (fixing process). When the surface property refreshing operation is ended, the integrated value stored in the memory Z is reset to 0. In the case where the print job is interrupted, the surface property refreshing operation for the fixing belt 105 is executed, and thereafter a remaining part of the print job is resumed.

Figure 15:
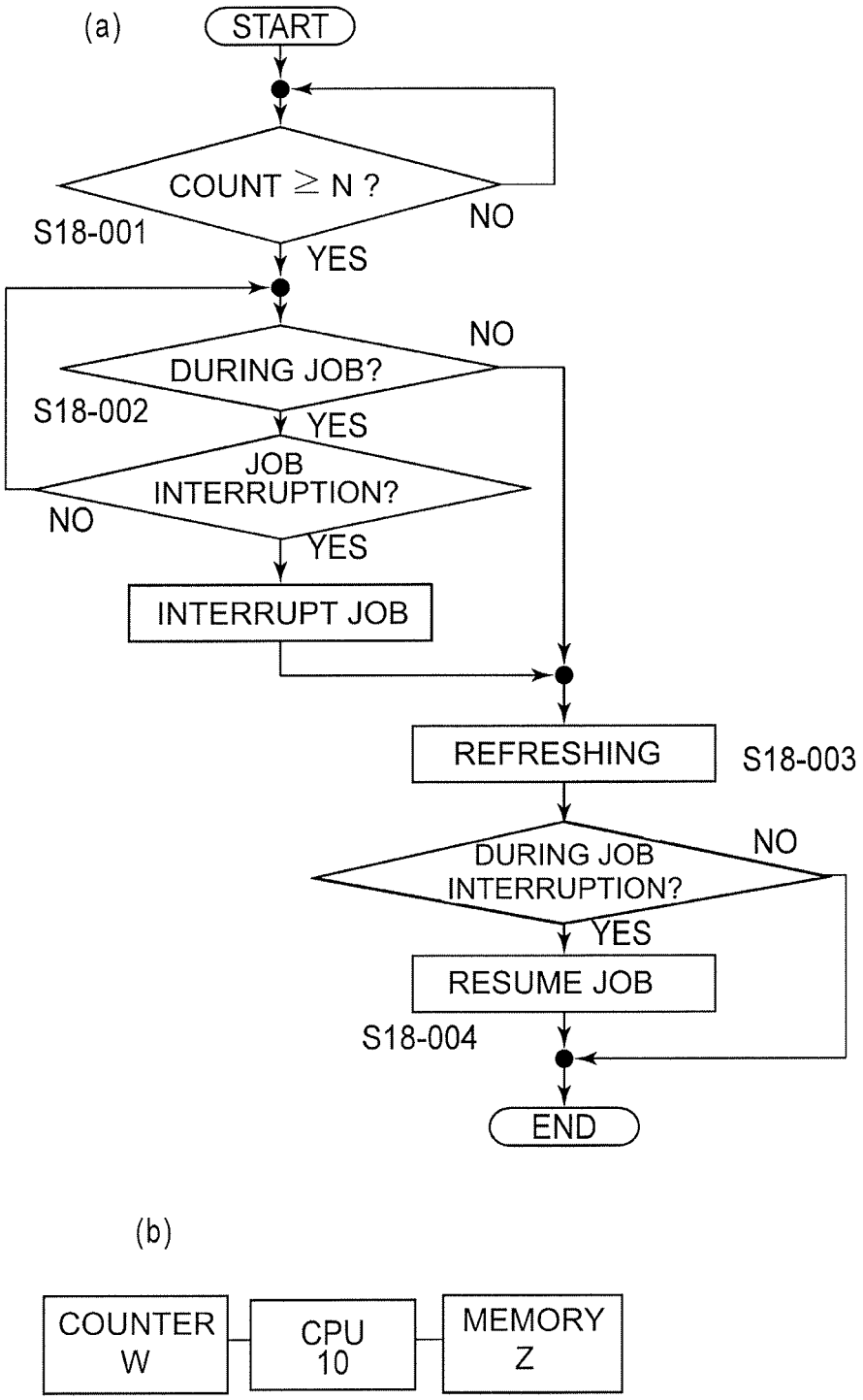
In FIG. 15, (a) is a control flowchart of a surface property refreshing operation (roughening operation), and (b) is a block diagram of a control system.

In (a) of FIG. 15, when the integrated value of a number of sheets subjected to passing (through the fixing device) is not less than a predetermined number N of sheets subjected to passing <S18-001>, the CPU 10 confirms the end of the print job being executed or temporarily interrupts the print job <S18-002>, and then, starts the surface property refreshing operation <S18-003>. Further, the counter is reset to 0. When the surface property refreshing operation is ended, the operation is in a state waiting for a subsequent print job or in the state waiting for the subsequent print job after the interrupted print job is resumed and the end thereof <S18-004>.

8) Air Blowing Mechanism

As mentioned above, the fixing belt 105 is subjected to rubbing by movement of the roughening roller 400 to the pressing position, so that the refreshing of the surface property thereof is made. In this case, the shavings of the fixing belt surface layer can generate at the roughening nip. The shavings remain on the fixing belt, so that the effect of the roughening process (rubbing process) can be impaired.

In order to prevent the shavings of the fixing belt surface layer by the roughening roller 400 from remaining on the fixing belt, the shavings of the fixing belt surface layer during the roughening process are diffused using an air blowing mechanism. In the following, a shaving diffusion constitution using this air blowing mechanism will be specifically described.

Figure 19:
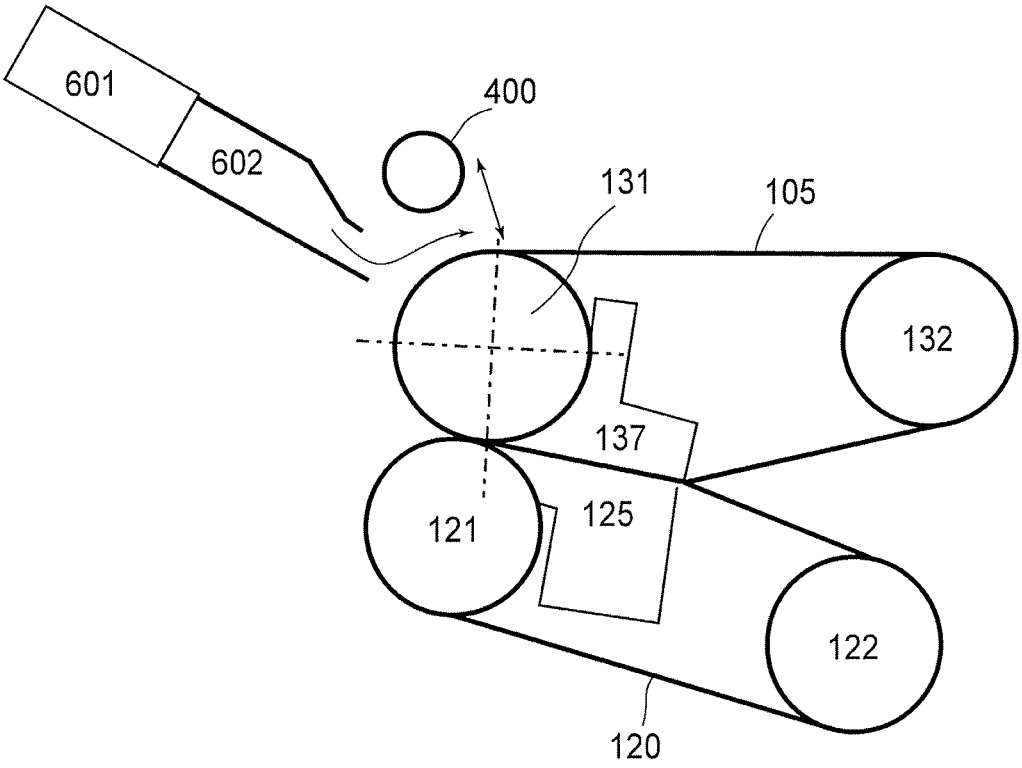
FIG. 19 is a schematic view of an air blowing constitution for diffusion of shavings.
Figure 20:
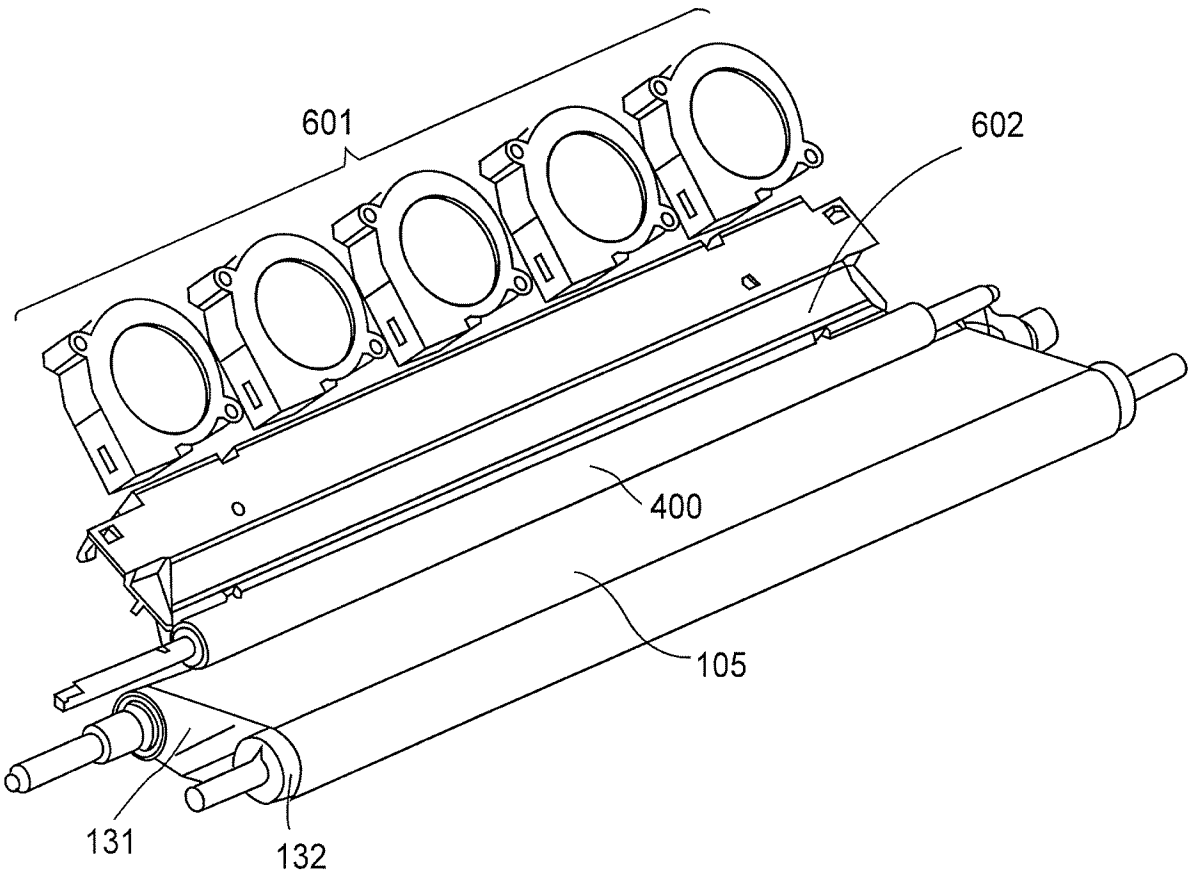
FIG. 20 is a perspective view of the air blowing constitution for the diffusion of the shavings.

FIG. 19 is a schematic view of the air blowing mechanism in this embodiment, and FIG. 20 is a perspective view of the air blowing mechanism. The air blowing mechanism includes a fan 601 and a duct 602. An operation of the fan 601 is controlled by the CPU 10 which is a controlling device. The fan 601 sends (blows) the air via the duct 602 toward the roughening nip (contact portion) R with the fixing belt 105 when the roughening roller 400 moves to the pressing position, so as to be capable of sending the air into an entire longitudinal region (entire widthwise region) toward the fixing belt 105.

In this embodiment, the roughening roller 400 moves from the position where the roughening roller 400 is pressed against (press-contacted to) the fixing belt 105 to the spaced position. At this time, the air is blown by driving the fan 601 toward the neighborhood of the roughening nip R, formed by the fixing belt 105 and the roughening roller 400, at a wind speed Vw (e.g., 10 m/s) via the duct 602. By this, the shavings of the fixing belt surface layer generated during the roughening operation are diffused. That is, the shavings of the fixing belt surface layer by the roughening roller 400 are prevented from remaining on the fixing belt, so that it becomes possible to suppress a lowering in refreshing efficiency of the surface property caused due to impairment of the roughening operation.

In this embodiment, during the rubbing process, the roughening roller 400 is disposed opposed to the driving roller 131 which is one of the plurality of supporting rollers for supporting the fixing belt 105 from an inner surface (of the fixing belt 105). Then, the roughening roller 400 is contacted (press-contacted) to the fixing belt 105 toward the driving roller 131, so that the roughening operation is performed.

Further, the fan 601 effects air blowing from an upstream side toward a downstream side with respect to the rotational direction of the fixing belt, whereby the diffusion of the shavings capable of remaining on the fixing belt is made. Here, when the roughening roller moves at least from the pressing position (contact position) to the spaced position, the air blowing by the fan 601 is made. Incidentally, also after the roughening roller moves from the pressing position to the spaced position, subsequently, the air blowing by the fan 601 is made for a predetermined time. Incidentally, the shaving can be diffused further, and is preferable.

Further, when the air blowing by the fan 601 is started at timing earlier than start timing of movement of the roughening roller from the pressing position to the spaced position, the diffusion can be made to some extent in advance, and therefore is preferable.

In the above, the preferred embodiment of the present invention was described, but within a scope of a concept of the present invention, various modifications are possible. In the above-described embodiment, the contact with the fixing belt by the rotatable rubbing member during the rubbing process was intermittent contact in which contact with the fixing belt and spacing from the fixing belt are repeated, but the contact is not limited thereto. That is, the contact may also be timewisely continuous contact with the fixing belt.

Further, in the above-described embodiment, the fixing device using the fixing belt and the pressing belt was described as an example. However, the present invention is not limited to such an example, but may also be similarly applicable to the case where a fixing roller is used instead of the fixing belt and the case where in place of the pressing belt, a pressing roller is used.

In the above-described embodiment, an example in which by rubbing the fixing belt with the roughening roller, the surface property thereof is substantially restored (the surface property is uniformized) was described, but such a constitution may also be applied to the pressing belt in place of the fixing belt. In addition, a constitution in which two rubbing rollers are provided and both of the fixing belt and the pressing belt are rubbed with the roughening rollers for the respective belts may also be employed.

Further, in the above-described embodiment, as the heating portion, the electromagnetic induction heating type was described, but the present invention is not limited thereto and is similarly applicable to also the case using another heating type, such as a halogen heater.

Further, the present invention is similarly applicable to also a fixing device including an external heating mechanism contacting an outer surface of the fixing belt and heating the fixing belt. In this case, the temperature of the fixing belt during the rubbing process may also be controlled by the external heating mechanism. Further, in the above-described embodiment, as the image heating apparatus, the fixing device for fixing the unfixed toner image on the sheet was described as an example, but the present invention is not limited thereto and is similarly applicable to also a device for heating and pressing the toner image fixed on the sheet in order to improve glossiness of the image.

INDUSTRIAL APPLICABILITY

According to the present invention, in an image heating apparatus including a rotatable rubbing member, even in the case where rubbing power of the rotatable rubbing member lowered, rubbing process can be properly performed.

The invention claimed is:

1. An image heating apparatus comprising:

a first rotatable member and a second rotatable member configured to form a nip for heating a toner image on a sheet;

a rotatable rubbing member configured to rub an outer surface of said first rotatable member;

a motor configured to move said rotatable rubbing member from a position in which said rotatable rubbing member is spaced from said first rotatable member toward a position in which said rotatable rubbing member contacts said first rotatable member, when a rubbing process is executed by said rotatable rubbing member; and a controller configured to control a temperature of said first rotatable member, depending on a number of times the rubbing process is executed by said rotatable rubbing member, when the rubbing process is executed.

2. An image heating apparatus according to claim 1, wherein said controller sets the temperature of said first rotatable member to a first temperature until the number of times reaches a predetermined number, and sets the temperature of said first rotatable member to a second temperature higher than the first temperature after the number of times reaches the predetermined number.

3. An image heating apparatus according to claim 1, wherein, when said rotatable rubbing member executes a single rubbing process, said motor alternately executes a first process for contacting said rotatable rubbing member with said first rotatable member, and a second process for spacing said rotatable rubbing member from said first rotatable member a plurality of times.

4. An image heating apparatus according to claim 3, further comprising an air blowing mechanism configured to blow air toward the position in which said rotatable rubbing member contacts said first rotatable member, wherein said air blowing mechanism blows the air when the second process is executed during the rubbing process.

5. An image heating apparatus according to claim 1, wherein said rotatable rubbing member is provided with an abrasive grain of #1000 to #4000 in count at a surface thereof.

6. An image heating apparatus according to claim 1, wherein a surface roughness Ra of said rotatable rubbing member is 1.0 or more, and 5.0 or less.

7. An image heating apparatus according to claim 1, wherein said rotatable rubbing member executes the rubbing process so that a surface roughness Rz of said first rotatable member is 0.5 or more, and 1.0 or less.

8. An image heating apparatus according to claim 1, wherein said first rotatable member is provided on a side at which said first rotatable member contacts the toner image on the sheet.

9. An image heating apparatus comprising:

a first rotatable member and a second rotatable member configured to form a nip for heating a toner image on a sheet;

a rotatable rubbing member configured to rub an outer surface of said first rotatable member;

a motor configured to move said rotatable rubbing member toward and away from said first rotatable member;

an executing portion configured to execute a rubbing process by said rotatable rubbing member, said executing portion being capable of executing the rubbing process a plurality of times; and a controller configured to control a temperature of said first rotatable member, depending on a total time of contact of said rotatable rubbing member with said first rotatable member, when the rubbing process is executed.

10. An image heating apparatus according to claim 9, wherein said controller sets the temperature of said first rotatable member to a first temperature until the total time reaches a predetermined time, and sets the temperature of said first rotatable member to a second temperature higher than the first temperature after the total time reaches the predetermined time.

11. An image heating apparatus according to claim 9, wherein, when said executing portion executes a single rubbing process by said rotatable rubbing member, said executing portion controls said motor to alternately execute a first process for contacting said rotatable rubbing member with said first rotatable member and a second process for spacing said rotatable rubbing member from said first rotatable member a plurality of times.

12. An image heating apparatus according to claim 11, further comprising an air blowing mechanism configured to blow air toward a contact position of said rotatable rubbing member with said first rotatable member, wherein said air blowing mechanism blows the air when the second process is executed during the rubbing process.

13. An image heating apparatus according to claim 9, wherein said rotatable rubbing member is provided with an abrasive grain of #1000 to #4000 in count at a surface thereof.

14. An image heating apparatus according to claim 9, wherein a surface roughness Ra of said rotatable rubbing member is 1.0 or more, and 5.0 or less.

15. An image heating apparatus according to claim 9, wherein said rotatable rubbing member executes the rubbing process so that a surface roughness Rz of said first rotatable member is 0.5 or more, and 1.0 or less.

16. An image heating apparatus according to claim 9, wherein said first rotatable member is provided on a side at which said first rotatable member contacts the toner image on the sheet.

17. An image forming apparatus comprising:

an image forming portion configured to form a toner image on a sheet;

a first rotatable member and a second rotatable member configured to form a nip for heating the toner image on the sheet formed by said image forming portion;

a heating portion configured to heat said first rotatable member so that a temperature of said first rotatable member is a target temperature;

a rotatable rubbing member configured to rub an outer surface of said first rotatable member;

a counting portion configured to count a number of times image formation is performed;

an executing portion configured to execute a rubbing process by said rotatable rubbing member depending on an output of said counting portion;

a motor configured to move said rotatable rubbing member from a position in which said rotatable rubbing member is spaced from said first rotatable member toward a position in which said rotatable rubbing member contacts said first rotatable member, when a rubbing process is executed by said rotatable rubbing member; and a controller configured to control the target temperature, depending on a number of times the rubbing process is executed by said rotatable rubbing member, when the rubbing process is executed.

18. An image forming apparatus according to claim 17, wherein said controller sets the target temperature to a first temperature until the number of times reaches a predetermined number, and sets the target temperature of said first rotatable member to a second temperature higher than the first temperature after the number of times reaches the predetermined number.

19. An image forming apparatus according to claim 17, wherein, when said executing portion executes a single rubbing process, said executing portion controls said motor to alternately execute a first process for contacting said rotatable rubbing member with said first rotatable member and a second process for spacing said rotatable rubbing member from said first rotatable member a plurality of times.

20. An image forming apparatus according to claim 19, further comprising an air blowing mechanism configured to blow air toward the position in which said rotatable rubbing member contacts said first rotatable member, wherein said air blowing mechanism blows the air when the second process is executed during the rubbing process.

21. An image forming apparatus according to claim 17, wherein said rotatable rubbing member is provided with an abrasive grain of #1000 to #4000 in count at a surface thereof.

22. An image forming apparatus according to claim 17, wherein a surface roughness Ra of said rotatable rubbing member is 1.0 or more, and 5.0 or less.

23. An image forming apparatus according to claim 17, wherein said rotatable rubbing member executes the rubbing process so that a surface roughness Rz of said first rotatable member is 0.5 or more, and 1.0 or less.

24. An image forming apparatus according to claim 17, wherein said counting portion counts a number of sheets subjected to the image formation.

25. An image forming apparatus according to claim 17, wherein said first rotatable member is provided on a side at which said first rotatable member contacts the toner image on the sheet.

26. An image forming apparatus according to claim 17, wherein said heating portion includes a coil configured to generate a magnetic flux for heating said first rotatable member through electromagnetic induction heating.

27. An image forming apparatus according to claim 17, wherein said executing portion executes the rubbing process when the number of times of image formation is a predetermined number or more.

28. An image forming apparatus comprising:

an image forming portion configured to form a toner image on a sheet;

a first rotatable member and a second rotatable member configured to form a nip for heating the toner image on the sheet formed by said image forming portion;

a heating portion configured to heat said first rotatable member so that a temperature of said first rotatable member is a target temperature;

a rotatable rubbing member configured to rub an outer surface of said first rotatable member;

a motor configured to move said rotatable rubbing member toward and away from said first rotatable member a plurality of times;

a counting portion configured to count a number of times image formation is performed;

an executing portion configured to execute a rubbing process by said rotatable rubbing member depending on an output of said counting portion, said executing portion being capable of executing the rubbing process a plurality of times; and a controller configured to control the target temperature, depending on a total time of contact of said rotatable rubbing member with said first rotatable member, when the rubbing process is executed.

29. An image forming apparatus according to claim 28, wherein said controller sets the target temperature to a first temperature until the total time reaches a predetermined time, and sets the target temperature to a second temperature higher than the first temperature after the total time reaches the predetermined time.

30. An image forming apparatus according to claim 28, wherein, when said executing portion executes a single rubbing process, said executing portion controls said motor to alternately execute a first process for contacting said rotatable rubbing member with said first rotatable member and a second process for spacing said rotatable rubbing member from said first rotatable member a plurality of times.

31. An image forming apparatus according to claim 30, further comprising an air blowing mechanism configured to blow air toward a contact position of said rotatable rubbing member with said first rotatable member, wherein said air blowing mechanism blows the air when the second process is executed during the rubbing process.

32. An image forming apparatus according to claim 28, wherein said rotatable rubbing member is provided with an abrasive grain of #1000 to #4000 in count at a surface thereof.

33. An image forming apparatus according to claim 28, wherein a surface roughness Ra of said rotatable rubbing member is 1.0 or more, and 5.0 or less.

34. An image forming apparatus according to claim 28, wherein said rotatable rubbing member executes the rubbing process so that a surface roughness Rz of said first rotatable member is 0.5 or more, and 1.0 or less.

35. An image forming apparatus according to claim 28, wherein said counting portion counts a number of sheets subjected to the image formation.

36. An image forming apparatus according to claim 28, wherein said first rotatable member is provided on a side at which said first rotatable member contacts the toner image on the sheet.

37. An image forming apparatus according to claim 28, wherein said heating portion includes a coil configured to generate a magnetic flux for heating said first rotatable member through electromagnetic induction heating.

38. An image forming apparatus according to claim 28, wherein said executing portion executes the rubbing process when the number of times of image formation is a predetermined number or more.

39. An image forming apparatus according to claim 1, wherein said rotatable rubbing member executes a single rubbing process and, thereafter, executes a subsequent single rubbing process after the toner image on the sheet is heated in the nip.

40. An image forming apparatus according to claim 9, wherein said executing portion executes a single rubbing process and, thereafter, executes a subsequent single rubbing process after the toner image on the sheet is heated in the nip.

41. An image forming apparatus according to claim 17, wherein said executing portion executes a single rubbing process and, thereafter, executes a subsequent single rubbing process after the image formation is performed.

42. An image forming apparatus according to claim 28, wherein said executing portion executes a single rubbing process and, thereafter, executes a subsequent single rubbing process after the image formation is performed.

43. An image forming apparatus comprising:

an image forming portion configured to form a toner image on a sheet;

a first rotatable member and a second rotatable member configured to form a nip for heating the toner image on the sheet formed by said image forming portion;

a heating portion configured to heat said first rotatable member so that a temperature of said first rotatable member is a target temperature;

a rotatable rubbing member configured to rub an outer surface of said first rotatable member;

a counting portion configured to count a number of times image formation is performed;

an executing portion configured to execute a rubbing process by said rotatable rubbing member depending on an output of said counting portion;

a motor configured to move said rotatable rubbing member from a position in which said rotatable rubbing member is spaced from said first rotatable member, toward a position in which said rotatable rubbing member contacts said first rotatable member, when the rubbing process is executed; and a controller configured to control the target temperature when the rubbing process is executed, wherein, when a total number of times image formation is performed is a first number, said controller sets, at a first temperature, the target temperature when the rubbing process is executed, and, when the total number of times image formation is performed is a second number that is greater than the first number, said controller sets, at a second temperature higher than the first temperature, the target temperature when the rubbing process is executed.

44. An image forming apparatus according to claim 43, wherein said rotatable rubbing member is provided with an abrasive grain of #1000 to #4000 in count at a surface thereof.

45. An image forming apparatus according to claim 43, wherein a surface roughness Ra of said rotatable rubbing member is 1.0 or more, and 5.0 or less.

46. An image forming apparatus according to claim 43, wherein said rotatable rubbing member executes the rubbing process so that a surface roughness Rz of said first rotatable member is 0.5 or more, and 1.0 or less.

47. An image forming apparatus according to claim 43, wherein said counting portion counts a number of sheets subjected to the image formation.

48. An image forming apparatus according to claim 43, wherein said first rotatable member is provided on a side at which said first rotatable member contacts the toner image on the sheet.

49. An image forming apparatus according to claim 43, wherein said heating portion includes a coil configured to generate a magnetic flux for heating said first rotatable member through electromagnetic induction heating.

50. An image forming apparatus according to claim 43, wherein said executing portion executes the rubbing process when the number of times of image formation is a predetermined number or more.

* * * * *